US005431086A

United States Patent [19]

Morita et al.

[11] Patent Number: 5,431,086

[45] Date of Patent: Jul. 11, 1995

[54] METHOD OF CONTROLLING CYLINDER APPARATUS

[75] Inventors: Masatoshi Morita, Kawasaki; Yusaku Azuma, Yokohama, both of Japan

[73] Assignee: Canon Kabushiki Kaisha, Tokyo, Japan

[21] Appl. No.: 155,161

[22] Filed: Nov. 19, 1993

[30] Foreign Application Priority Data

Nov. 25, 1992 [JP] Japan ..... 4-314563

[51] Int. Cl.[6] ..... F15B 13/16

[52] U.S. Cl. ..... 91/361; 91/389; 91/393; 60/469

[58] Field of Search ..... 91/165, 166, 361, 364, 91/393, 389; 60/394, 469

[56] References Cited

U.S. PATENT DOCUMENTS 4,399,653 8/1983 Pylat ..... 60/327
4,651,621 3/1987 Eastman ..... 91/361
4,901,625 2/1990 Bussan et al. ..... 91/361

FOREIGN PATENT DOCUMENTS 416335 1/1992 Japan .

*Primary Examiner*—F. Daniel Lopez
*Attorney, Agent, or Firm*—Fitzpatrick, Cella, Harper & Scinto

[57] ABSTRACT

A method of controlling a cylinder apparatus includes the steps of supplying compressed air of a first high pressure to one chamber of a cylinder which is divided into two chambers by a piston, and exhausting air from the other chamber so as to move the piston from the start position at an end portion of one chamber toward an end position at an end portion of the other chamber along the extending direction of the cylinder, and detecting if the position has passed the position of a sensor. In addition, a moving speed of the piston is decreased by supplying air of a second high pressure lower than the first high pressure to the other chamber after an elapse of a predetermined wait time from when the piston has passed the position of the sensor, so that the piston reaches the end position in a shock-free state.

23 Claims, 28 Drawing Sheets

METHOD OF CONTROLLING CYLINDER APPARATUS

BACKGROUND OF THE INVENTION

The present invention relates to a method of controlling a cylinder apparatus which is driven by pneumatic pressure.

In a cylinder apparatus, as a method of preventing a piston from colliding against the inner wall of a cylinder at the end point position of the cylinder at high speed by decelerating the moving piston halfway through the stroke, a method disclosed in Japanese Patent Application No. 4-16335 which was previously filed by the present applicant is known.

In this method, as shown in the flow chart in FIG. 1, compressed air of a first high pressure is supplied to one chamber of a cylinder, which is divided into two chambers by a piston, and air is exhausted from the other chamber, thereby moving the piston in the extending direction of the cylinder. When the piston passes a position in front of a sensor attached at the middle position of the cylinder, air of a second high pressure lower than the first high pressure is supplied into the other chamber, thereby decreasing the moving speed of the piston.

However, in the above-mentioned prior art, since the sensor for detecting the deceleration start position is fixed at a specific position of the cylinder, the following problems are posed.

More specifically, in a normal cylinder apparatus, as a result of continuous movement of the piston, the sliding resistance of the piston gradually changes due to a temperature rise caused by the friction of a seal portion of the cylinder or due to spread of an oil in the entire cylinder. For this reason, when the sensor is fixed at a specific position, and the deceleration start point is fixed in position all the time, even if the piston can smoothly reach the end point in an initial state, the piston may stop before it reaches the end point, or may reach the end point before it is sufficiently decelerated, with an elapse of time. When the piston stops halfway, an object to be conveyed by the piston cannot be conveyed to a target position. Conversely, when the piston reaches the end position before it is sufficiently decelerated, the piston collides against the inner wall of the cylinder, and is damaged. In order to solve these problems, the sensor for detecting the deceleration start position can be moved with respect to the cylinder to adjust the deceleration start position of the piston. However, such an adjustment is very troublesome.

SUMMARY OF THE INVENTION

The present invention has been made in consideration of the above situation, and has as its object to provide a method of controlling a cylinder apparatus, which can stop a piston at the end point position in a shock-free state without requiring any position adjustment of a sensor.

In order to achieve the above object, according to the first aspect of the present invention, a method of controlling a cylinder apparatus comprises the following steps.

More specifically, a method of controlling a cylinder apparatus comprises: the first step of supplying compressed air of a first high pressure to one chamber of a cylinder which is divided into two chambers by a piston, and exhausting air from the other chamber so as to move the piston from a start position as an end portion of one chamber toward an end position as an end portion of the other chamber along an extending direction of the cylinder; the second step of causing first detection means, arranged on the cylinder, for detecting a position of the piston, to detect that the piston has passed a position matching a position of the first detection means; and the third step of decreasing a moving speed of the piston by supplying air of a second high pressure lower than the first high pressure to the other chamber after an elapse of a predetermined wait time from when the first detection means detects that the piston has passed the position matching the position of the first detection means, so that the piston reaches the end position in a shock-free state.

According to the second aspect of the present invention, a method of controlling a cylinder apparatus comprises the following steps.

More specifically, a method of controlling a cylinder apparatus comprises: the first step of supplying compressed air of a first high pressure to one chamber of a cylinder which is divided into two chambers by a piston, and exhausting air from the other chamber so as to move the piston from a start position as an end portion of one chamber toward an end position as an end portion of the other chamber along an extending direction of the cylinder; the second step of causing detection means, arranged on the cylinder, for detecting a position of the piston to detect a remaining moving distance as a distance between a current position of the piston and the end position; and the third step of decreasing a moving speed of the piston by supplying air of a second high pressure lower than the first high pressure to the other chamber when the remaining moving distance becomes equal to a predetermined distance, so that the piston reaches the end position in a shock-free state.

Other objects and advantages besides those discussed above shall be apparent to those skilled in the art from the description of a preferred embodiment of the invention which follows. In the description, reference is made to accompanying drawings, which form a part hereof, and which illustrate an example of the invention. Such example, however, is not exhaustive of the various embodiments of the invention, and therefore reference is made to the claims which follow the description for determining the scope of the invention.

DETAILED DESCRIPTION OF THE PREFERRED EMBODIMENTS

The preferred embodiments of the present invention will be described in detail hereinafter with reference to the accompanying drawings.

(First Embodiment)

Figure 1:
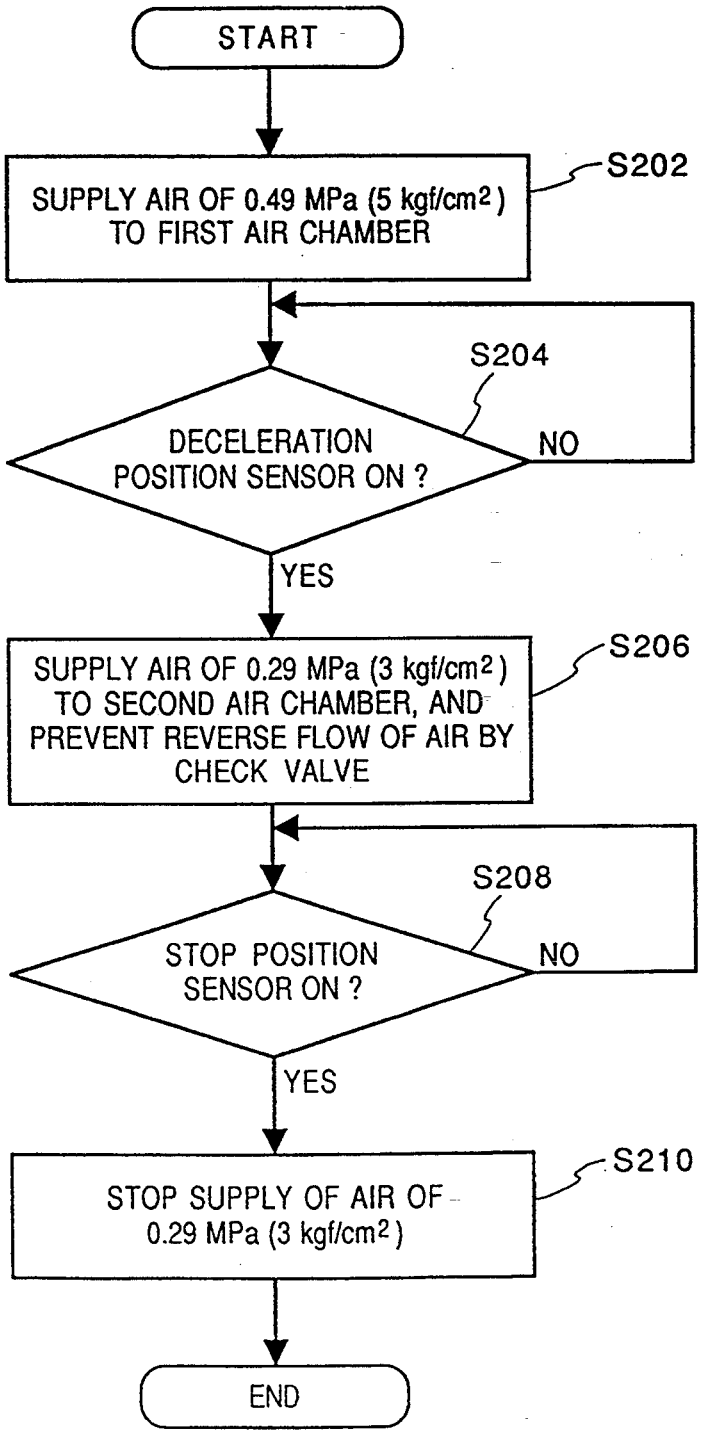
FIG. 1 (PRIOR ART)
FIG. 1 is a flow chart for explaining a conventional method of controlling a cylinder apparatus.
Figure 2:
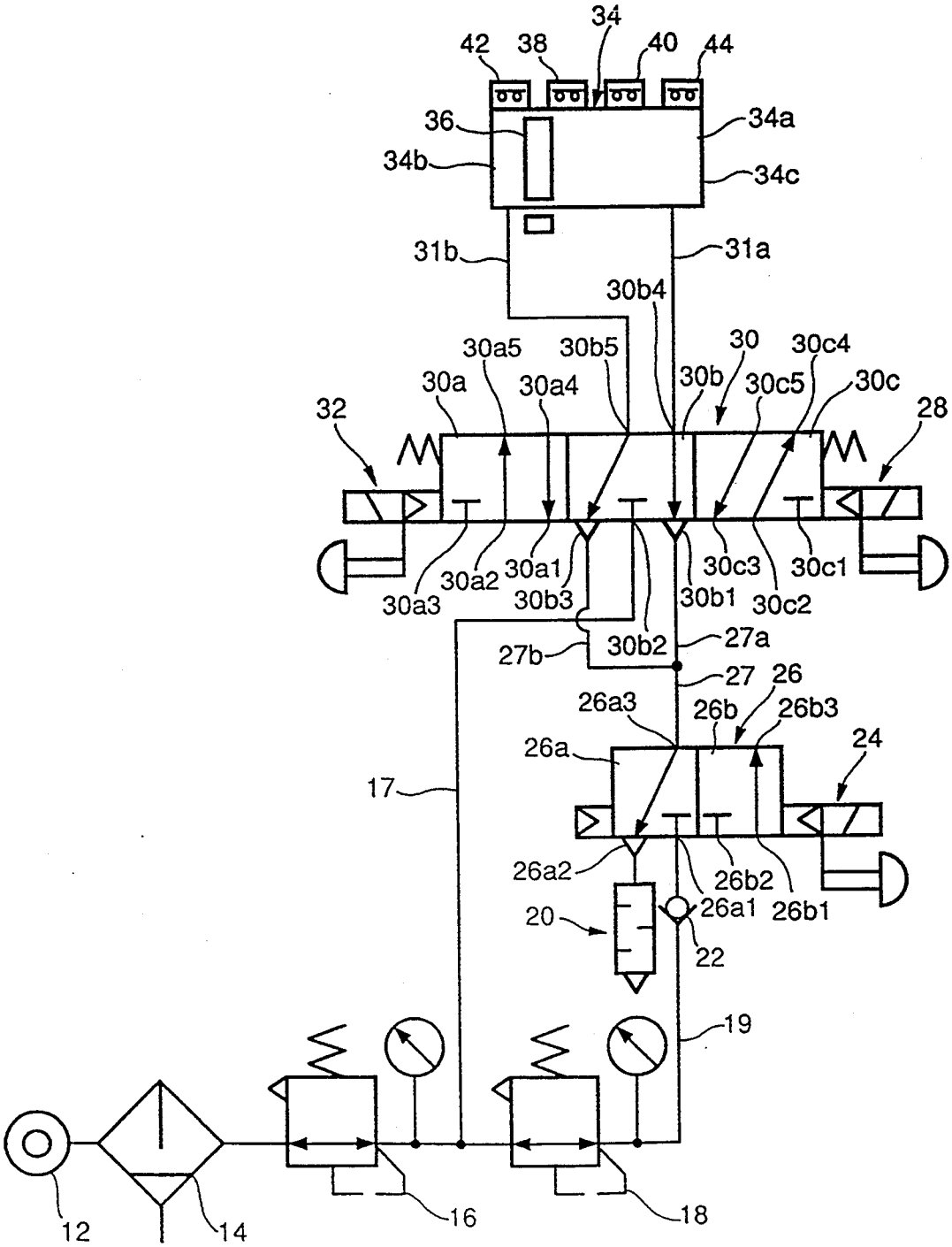
FIG. 2 is a pneumatic pressure circuit diagram showing an arrangement of a cylinder apparatus to which a control method of the first embodiment is applied.

FIG. 2 is a pneumatic circuit diagram showing an arrangement of a cylinder apparatus to which a control method of the first embodiment is applied.

Referring to FIG. 2, reference numeral 12 denotes an air supply source, which supplies compressed air to a pneumatic pressure rodless cylinder 34. The air supply source 12 is connected to a filter 14 for removing impurities such as an oil from air supplied from the air supply source 12. The filter 14 is further connected to a first pressure adjustment device 16, which adjusts air supplied from the air supply source 12 to a first high pressure (e.g., 0.49 MPa (5 kgf/cm$^2$). An air communication path is divided into two paths behind the pressure adjustment device 16. One divided path is connected to a second pressure adjustment device 18, and the other divided path is connected to a second port **30*b*2 of a second solenoid valve 30 via a branch communication path 17**.

The second pressure adjustment device 18 adjusts air supplied from the air supply source 12 to a second high pressure (e.g., 0.29 MPa (3 kgf/cm$^2$). With this second high pressure, a piston 36 is braked by a method to be described later. When the second high pressure is changed, the braking force acting on the piston 36 can be changed. A first solenoid valve 26 is connected behind the second pressure adjustment device 18 via a check valve 22. The first solenoid valve 26 is a 2-position, 3-port valve, and is switched between two positions by a solenoid 24 connected to the first solenoid valve 26. When the solenoid 24 is in an OFF state, the first solenoid valve 26 is in a state illustrated in FIG. 2, and compressed air passing through the check valve 22 is supplied to a first port **26*a*1 of the first solenoid valve 26. In this state, as shown in FIG. 2, since the first port 26*a*1 is closed, the compressed air supplied from the second pressure adjustment device 18 to the first port 26*a*1 via the check valve 22** is in a sealed state.

On the other hand, a second port **26*a*2 of a first chamber 26*a* is connected to a muffler 20. As will be described later, air flows exhausted from two air chambers 34*a* and 34*b* of the pneumatic cylinder 34 are exhausted to the air via the muffler 20. In order to guide the air exhausted from the air chambers of the pneumatic cylinder 34 in this manner, an air communication path 27 is connected to a third port 26*a*3 of the first solenoid valve 26. The air communication path 27 is branched into two air communication paths at its upstream side. One air communication path 27*a* is connected to a first port 30*b*1 of the second solenoid valve 30. The other air communication path 27*b* is connected to a third port 30*b*3 of the second solenoid valve 30**.

The second solenoid valve 30 is a 3-position, 5-port solenoid valve, and is switched among three positions by solenoids 28 and 32 connected to the second solenoid valve 30. When the solenoids 28 and 32 are in an OFF state, the second solenoid valve 30 is set in a state illustrated in FIG. 2, and compressed air passing through the branch communication path 17 is supplied to the second port **30*b*2 of the second solenoid valve 30. In this state, as shown in FIG. 2, since the second port 30*b*2 is closed, the compressed air supplied from the first pressure adjustment device 16 to the second port 30*b*2 via the branch communication path 17** is in a sealed state.

Also, in this state, an air communication path **31*a* connected to the first air chamber 34*a* of the pneumatic cylinder 34 is connected to a fourth port 30*b*4 of the second solenoid valve 30, and an air communication path 31*b* connected to the second air chamber 34*b* is connected to a fifth port 30*b*5 of the second solenoid valve. Therefore, when all the solenoids 24, 28, and 32 are kept OFF, both the first and second air chambers 34*a* and 34*b* are open to the air via the muffler 20**.

The pneumatic cylinder 34 comprises the piston 36 in a pneumatic cylinder main body **34*c*. When this piston 36 moves along the longitudinal direction of the pneumatic cylinder main body 34c, an object which is to be moved and is fixed to the piston 36 is moved. When compressed air is supplied to the first air chamber 34a, and air is exhausted from the second air chamber 34b, the piston 36 moves from the right side toward the left side in FIG. 2 with respect to the pneumatic cylinder main body 34c. Conversely, when compressed air is supplied to the second air chamber 34b, and air is exhausted from the first air chamber 34a, the piston 36 moves from the left side toward the right side in FIG. 2 with respect to the pneumatic cylinder main body 34c**.

The pneumatic cylinder main body 34c comprises four position sensors for detecting the position of the piston. Of these four position sensors, two sensors are middle position sensors 38 and 40 for detecting the moving position of the piston 36, and the remaining two sensors are stop position sensors 42 and 44 for detecting the stop position of the piston 36.

Each of the middle position sensors 38 and 40 detects passage of the piston 36 in front of the sensor, and outputs a detection signal indicating the passage to a CPU (to be described later). The stop position sensor 42 detects that the piston 36 ends its movement, and reaches the left end portion of the pneumatic cylinder main body 34c, and also detects that the piston 36 begins to move from the left to the right. Similarly, the stop position sensor 44 detects that the piston 36 ends its movement, and reaches the right end portion of the pneumatic cylinder main body 34c, and also detects that the piston 36 begins to move from the right to the left.

Figure 3:
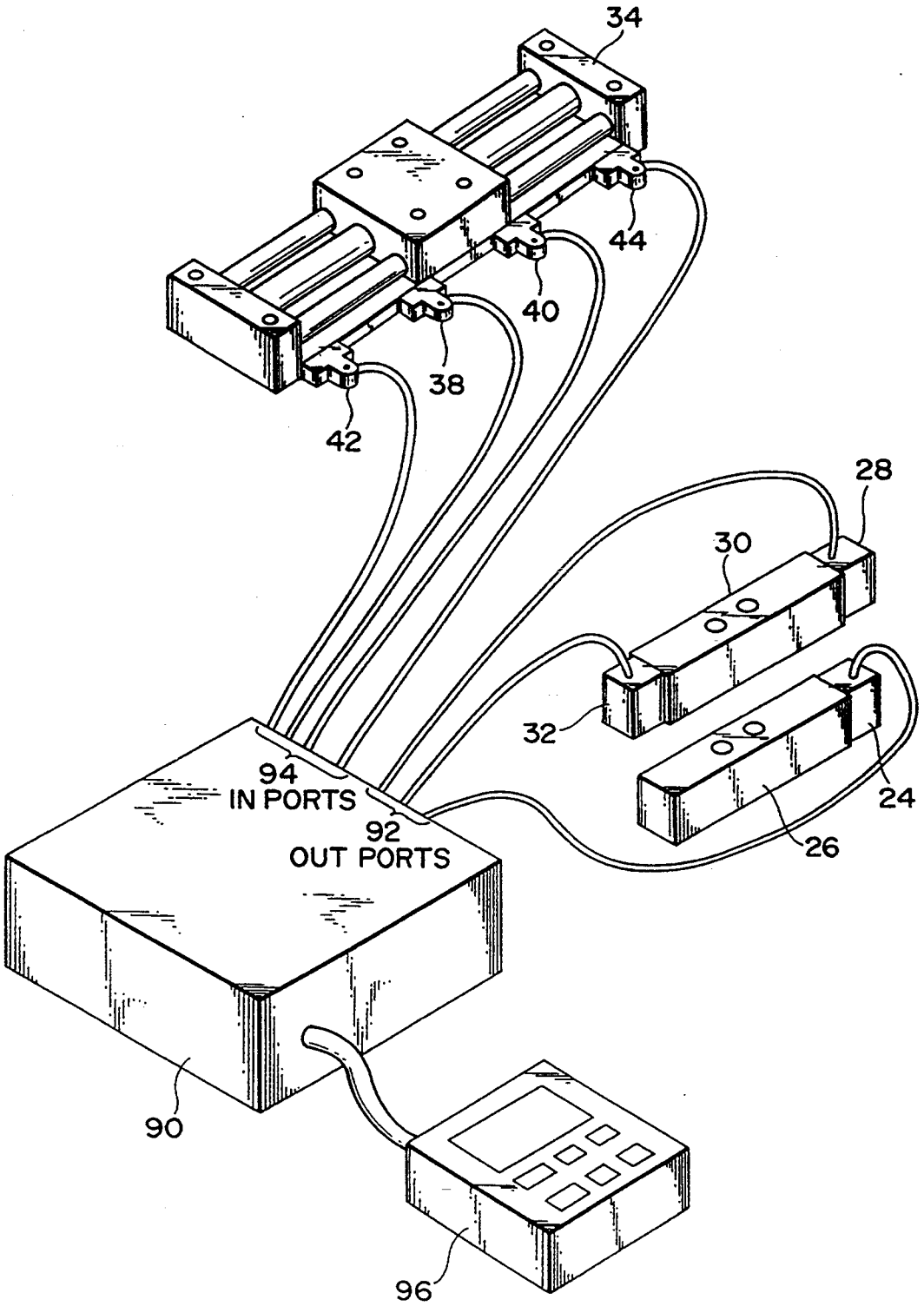
FIG. 3 is a perspective view showing the connection state among a controller, solenoids, and position sensors.

FIG. 3 is a perspective view showing the connection state among a controller, the solenoids, and the position sensors.

Referring to FIG. 3, reference numeral 90 denotes a controller for controlling the entire cylinder apparatus. The controller 90 has a plurality of OUT ports 92 for outputting control electrical signals, and a plurality of IN ports 94 for receiving control electrical signals. More specifically, the controller 90 comprises at least three OUT ports 92, which are connected to the solenoid 24 of the first solenoid valve 26, and the solenoids 28 and 32 of the second solenoid valve 30. The controller 90 comprises at least four IN ports 94, which are connected to the middle position sensors 38 and 40, and the stop position sensors 42 and 44.

The controller 90 is connected to an input device 96 used for inputting data required for controlling the operation of the entire cylinder apparatus. The output timings of signals to be output to the OUT ports 92 are controlled on the basis of information of detection signals input to the IN ports 94, data input from the input device 96, and a program in the controller 90. The input device 96 also has a communication function of sending a program to the controller 90.

Figure 4:
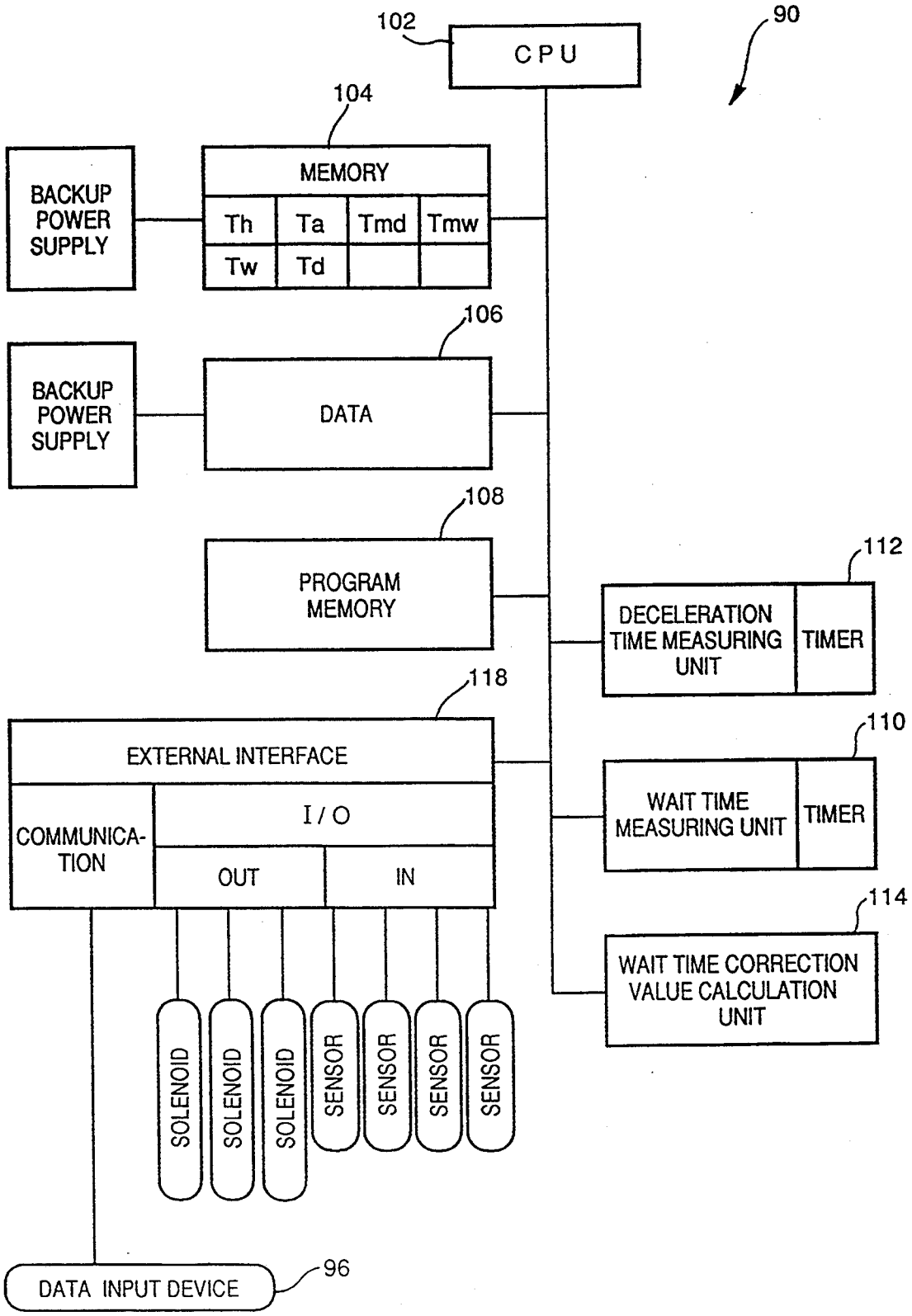
FIG. 4 is a block diagram of a system in the controller.

FIG. 4 is a block diagram showing a system in the controller 90. The controller 90 comprises a CPU (central numerical processing unit) 102 for controlling various numerical processing operations, a rewritable memory 104 which can hold internal information by a backup power supply after a main power supply is turned off, a data unit 106 in which data can be written at least once, and which can hold the written data, a program memory 108 for storing a program required in the CPU 102, and a wait time measuring unit 110 for supplying an end signal to the CPU 102 after an elapse of a predetermined period of time from when the signal is input from the middle position sensor 38. The wait time measuring unit 110 comprises at least one independent timer. Also, the controller 90 comprises a deceleration time measuring unit 112 for measuring a time from when the end signal output from the wait time measuring unit 110 or a start command signal output from the CPU 102 is received until the stop position sensor 42 or 44 outputs an arrival signal of the piston 36, a wait time correction value calculation unit 114 for calculating a correction value required for correcting the wait time on the basis of an actual deceleration time and a target deceleration time, and an external interface 118 for performing communications with the data input device 96. These constituting elements of the controller 90 need not always be stored in a single housing, but may be independently arranged as long as they are connected via communication means.

The operation of the cylinder apparatus with the above-mentioned arrangement will be described below.

As a pre-procedure upon conveying, e.g., a work in practice by the cylinder apparatus, a target deceleration time Tmd which is a time from the beginning of deceleration to the stop of the piston 36 and which minimizes a shock upon stopping of the piston 36 must be measured. The measurement procedure will be described below.

In an initial state, assume that all the solenoids 24, 28, and 32 are set in an OFF state (the state illustrated in FIG. 2), and the piston 36 is located at the right end (FIG. 2) of the pneumatic cylinder main body 34c.

A weight having the same weight as that of a workpiece to be conveyed, or a work (or workpiece) itself is attached to the piston 36 to attain the same state as an actual operation state. In this embodiment, assume that the weight of the work is 3 kgf. In this state, compressed air of 0.49 MPa (5 kgf/cm$^2$) is supplied from the first pressure adjustment device 16 into the first air chamber 34a of the pneumatic cylinder 34, and air in the second air chamber 34b is exhausted to the air from the muffler 20 via the first solenoid valve 26. Thus, the piston 36 begins to move from the right end toward the left end of the pneumatic cylinder main body 34c. Simultaneously with passage of the piston 36 in front of the middle position sensor 38, compressed air of 0.29 MPa (3 kgf/cm$^2$) is supplied from the second pressure adjustment device 18 to the second air chamber 34b, thus braking the piston 36. At this time, the middle position sensor 38 is attached to a proper position of the pneumatic cylinder main body 34c. When the piston 36 is braked, the piston 36 moves toward the end point position at the left end position of the pneumatic cylinder main body 34c while being decelerated, and finally stops.

The stop position is determined by the braking start position of the piston 36, i.e., the position, in the right-and-left direction in FIG. 2, of the middle position sensor 38. Therefore, depending on the attached position of the middle position sensor 38, the piston 36 may stop before it reaches the end point, may stop just at the end point position, or may not stop before it reaches the end point position, and may collide against the left inner wall of the pneumatic cylinder main body 34c. Of these cases, it is most preferable that the piston 36 be stopped just at the end point position.

The position of the middle position sensor 38 is experimentally obtained, so that the piston 36 stops just at the end point position. In practice, however, since the sliding resistance or the like of a bearing slightly changes every time the piston 36 moves, it is impossible to always stop the piston 36 just at the end point position. When the piston 36 stops before it reaches the end point position, a work or the like as an object to be conveyed cannot be conveyed to the target position, thus posing another problem. For this reason, in practice, the position of the middle position sensor 38 is adjusted, so that the piston 36 collides against the end point position with a slight shock, and stops at that position.

In this case, the magnitude of the shock upon collision of the piston 36 against the end point position is determined by detecting the acceleration of the piston 36 at the time of collision or measuring the amplitude of a vibration in the longitudinal direction of the cylinder 34. The position of the middle position sensor 38 is adjusted so as to reduce the shock upon collision of the piston 36 as much as possible. The position adjustment of the middle position sensor 38 is experimentally attained by repetitively moving the piston 36. One characteristic feature of this embodiment will be described below. That is, in a state wherein the position of the middle position sensor 38 is adjusted to an optimal deceleration start position, the piston 36 is moved, the time from an instance when the piston 36 passes in front of the middle position sensor 38 (from this instance, the piston 36 begins to decelerate) until the piston stops is measured, and the measured time is determined to be the target deceleration time Tmd. Even when the sliding resistance or the like changes during the continuous operation of the cylinder apparatus, and the moving speed of the piston 36 changes, if the time from when the piston 36 begins to decelerate until the piston 36 stops coincides with the target deceleration time Tmd, it is experientially confirmed that the piston 36 stops at the end point position in an optimal state.

An operation for moving the piston 36 of the pneumatic cylinder 34 from the right end to the left end (FIG. 2) on the basis of the target deceleration time Tmd, which is measured, as described above, and stopping the piston 36 without any shock will be described below with reference to the flow charts shown in FIGS. 5 and 6.

In an initial state, assume that all the solenoids 24, 28, and 32 are set in an OFF state (the state illustrated in FIG. 2), and the piston 36 is located at the right end (FIG. 2) of the pneumatic cylinder main body 34c. Also, assume that the middle position sensor 38 is arranged at a position slightly offset from the above-mentioned optimal deceleration start position to the right side. The time required for moving the piston 36 from the actual position of the middle position sensor 38 to the above-mentioned optimal deceleration start position will be referred to as a target wait time Tmw (to be described later) hereinafter. More specifically, when the piston 36 begins to brake after an elapse of the target wait time Tmw from an instance when the piston 36 passes in front of the middle position sensor 38, the piston 36 can be stopped at the end point position in an optimal state. Also, assume that the same additional load (in the above-mentioned case, 3 kgf) as that upon measurement of the target deceleration time is imposed on the piston 36.

Step S1 is the start step. In step S2, a wait time correction value Th in the memory is set to be 0. The timer value of a timer is reset to 0. In step S3, the control waits for a moving command output from the CPU 102. When the moving command is output, the flow advances to step S4. In step S4, the controller 90 outputs a signal for turning on one solenoid 28 of the second solenoid valve 30 from an OUT port 92 to connect a second port 30c2 of a third chamber 30c of the second solenoid valve 30 to the branch communication path 17, and to connect a fourth port 30c4 to the air communication path 31a, thus supplying compressed air of 0.49 MPa (5 kgf/cm$^2$) from the first pressure adjustment device 16 into the first air chamber 34a of the pneumatic cylinder 34. At the same time, a third port 30c3 of the third chamber 30c of the second solenoid valve 30 is connected to the air communication path 27b, and a fifth port 30c5 is connected to the air communication path 31b, thus exhausting air in the second air chamber 34b of the pneumatic cylinder 34 to the air from the muffler 20 via the first solenoid valve 26. Then, the piston 36 begins to move from the right side toward the left side with respect to the pneumatic cylinder main body 34c. At this time, as described above, since the air in the second air chamber 34b is released to the air without any resistance, the piston 36 receives almost no counter pressure by the pressure in the second air chamber 34b, and begins to move at a very high speed.

In step S5, the predetermined target wait time Tmw described above and the wait time correction value Th stored in the memory are added to each other, and the sum Tw is stored in the memory. The value Tw will be referred to as a wait time hereinafter. Since Th=0 is initially set, Tw=Tmw.

In step S6, the control waits until the middle position sensor 38 is turned on. When the sensor 38 is turned on, the flow advances to step S7. In step S7, the timer of the wait time measuring unit 110 is started. In step S8, the wait time Tw calculated in step S5 is compared with the value of the timer started in step S7, and the control waits until the timer value becomes equal to or larger than the wait time Tw. When the timer value becomes equal to or larger than the wait time Tw, the flow advances to step S9.

In step S9, a timer of the deceleration time measuring unit 112 is started, and the timer of the wait time measuring unit 110 is stopped. At the same time, the controller 90 turns on the solenoid 24 of the first solenoid valve 26. Then, a first port 26b1 of a second chamber 26b of the first solenoid valve 26 is connected to an air communication path 19, and a third port 26b3 is connected to the air communication path 27. As a result, compressed air of 0.29 MPa (3 kgf/cm$^2$) is supplied from the second pressure adjustment device 18 into the second air chamber 34b of the pneumatic cylinder 34. At this time, since the reverse flow of compressed air from the second pressure adjustment device 18 is prevented by the check valve 22, air will never reversely flow from the second air chamber 34b of the pneumatic cylinder, and the pressure in the second air chamber 34b steadily increases. Thus, the piston begins to decelerate.

In step S10, the controller 90 waits until the piston 36 moves to the position of the stop position sensor 42 (the left end position of the pneumatic cylinder main body 34c), the stop position sensor 42 responds, and a detection signal is input from an IN port 94. In step S10, when the detection signal is input from the IN port 94, the flow advances to step S11.

In step S11, the timer of the deceleration time measuring unit 112 is stopped, and this time is stored in the memory 104 as a deceleration time Td. In step S12, a deviation Th' between the target deceleration time Tmd and the deceleration time Td is calculated. In this case, when the deviation Th'=0, i.e., when the actual deceleration time Td coincides with the target deceleration time Tmd, it indicates that the piston 36 has stopped at the end point position in a shock-free state, i.e., in an optimal state.

Then, the deviation Th' is multiplied with a predetermined constant Tk (e.g., 1/5). The product is determined to be the wait time correction value Th. When the piston 36 is moved from the right to the left next time, the wait time correction value Th is added to the target wait time Tmw to obtain the actual wait time Tw in step S8. Thus, the deviation between the actual deceleration time Td and the target deceleration time Tmd is fed back to the next operation of the piston 36, and when the moving operation of the piston 36 is repeated several times, the actual deceleration time Td converges to the target deceleration time Tmd. If the deviation Th' is 0, since Th is also 0, the actual wait time Tw is left unchanged in the next movement of the piston 36, and the deceleration of the piston 36 is started at the same timing as the current timing.

The reason why the value of the deviation Th' is not directly used as the wait time correction value Th is as follows. That is, since the frictional resistance or the like of a bearing of the cylinder apparatus slightly changes every time the piston 36 moves, if the deviation Th' is directly used as the wait time correction value Th, the value of the deceleration time Td may not converge to the target deceleration time Tmd. For this reason, when the deviation between the deceleration time Td and the target deceleration time Tmd becomes close to zero but does not easily become zero, the constant Tk is increased. When the deviation oscillates, i.e., when the sign of the deviation changes like +, −, +, −, . . . , the value of the constant Tk is decreased.

In this embodiment, $Th = Tk \times Th'$. Alternatively, the relationship between the wait time correction value Th and the deviation Th' may be expressed by a table. In this case, for example, if the deviation Th' falls within a range from 0 to 10, the wait time correction value Th may be set to be 3, and if the deviation Th' falls within a range from 10 to 20, the wait time correction value Th may be set to be 5.

In step S13, the value Th stored in the memory 104 is updated with the value of the wait time correction value Th calculated in step S12. The wait time correction value Th stored in the memory 104 is used in the next movement of the piston 36 from the right end to the left end. In this step, the solenoid 24 of the solenoid valve 26 is turned off. Then, the compressed air to the second air chamber **34*b*** is exhausted to the air.

In step S14, the controller 90 measures an elapsed time from when the stop position sensor 42 responds, and a detection signal is input from an IN port 94. When the elapsed time has reached 0.5 sec, the controller 90 supplies a signal from an OUT port 92 to turn off the solenoid 28 of the second solenoid valve 30. Then, the second solenoid valve 30 is restored to the state illustrated in FIG. 2, and compressed air staying between the first air chamber **34*a* of the pneumatic cylinder 34 and the second solenoid valve 30 is exhausted to the air from the muffler 20**.

In this manner, after an elapse of about 1 sec from when the solenoid 28 is turned off, the pressures in the first and second air chambers **34*a* and 34*b* of the pneumatic cylinder 34 become equal to the atmospheric pressure. Thus, the moving operation of the piston 36 from the right end to the left end in FIG. 2** ends.

Note that movement of the piston 36 from the left end to the right end is controlled in the same manner as in the movement from the right end to the left end.

In the first embodiment, compressed air components in the first and second air chambers are exhausted to the air before cylinder movement is started. Alternatively, air at the movement destination side may be released (exhausted) simultaneously with the beginning of cylinder movement. At this time, it is more effective to attach a quick exhaust valve to an exhaust port.

Note that in the system of this embodiment, the second high pressure supplied from the second pressure adjustment device 18 can be the same as the first high pressure supplied from the first pressure adjustment device 16.

In this embodiment, a moving command is output to actually move the piston, a wait time correction value Th is calculated to eliminate the deviation between a deceleration time Td measured at that time and a target deceleration time Tmd, and the calculated value is added to a target wait time Tmw in the next movement. Thus, even when the sliding resistance or the like of a bearing of the cylinder apparatus changes as time elapses, the piston can be smoothly stopped all the time.

The system of this embodiment can also be applied to a rotary actuator without being modified.

An application utilizing the above-mentioned cylinder apparatus will be described below.

Figure 7:
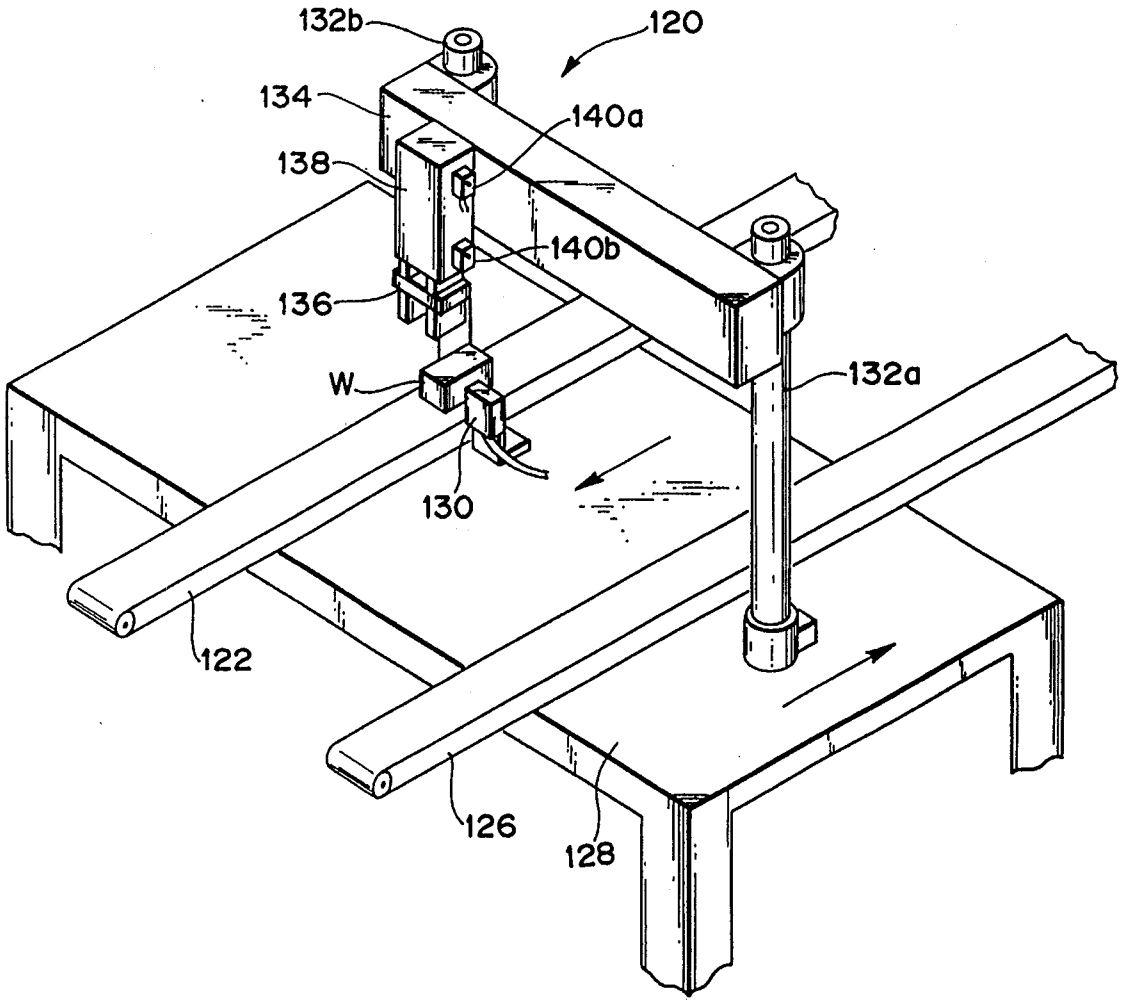
FIG. 7 is a perspective view showing the structure of a pneumatic type auto-hand.

FIG. 7 is a perspective view showing the structure of a pneumatic type auto-hand 120. The auto-hand 120 performs, e.g., an operation for transferring a work W conveyed by a belt conveyor 122 onto another belt conveyor 126. On a base 128 on which the belt conveyors 122 and 126 are arranged, a sensor 130 for detecting the work W is arranged at a position adjacent to the belt conveyor 122.

The auto-hand 120 is mainly constituted by two columns **132*a* and 132*b* standing upright on the base 128, a horizontal pneumatic cylinder 134 extending between the two columns 132*a* and 132*b*, and a vertical driving cylinder 138, which is moved by the pneumatic cylinder 134 in the horizontal direction, and has a function of driving a finger 136 in the vertical direction. On the vertical driving cylinder 138, a sensor 140*a* for detecting if the finger 136 reaches the upper end position, and a sensor 140*b* for detecting if the finger 136** reaches the lower end position are arranged.

In the auto-hand 120 with the above-mentioned arrangement, the pneumatic cylinder 134 for moving the vertical driving cylinder 138 in the horizontal direction corresponds to a cylinder apparatus which adopts the control method of the above-mentioned embodiment.

An operation for transferring a work W from the belt conveyor 122 to the belt conveyor 126 by the auto-hand 120 with the above arrangement will be described below with reference to the flow chart shown in FIG. 8.

Figure 8:
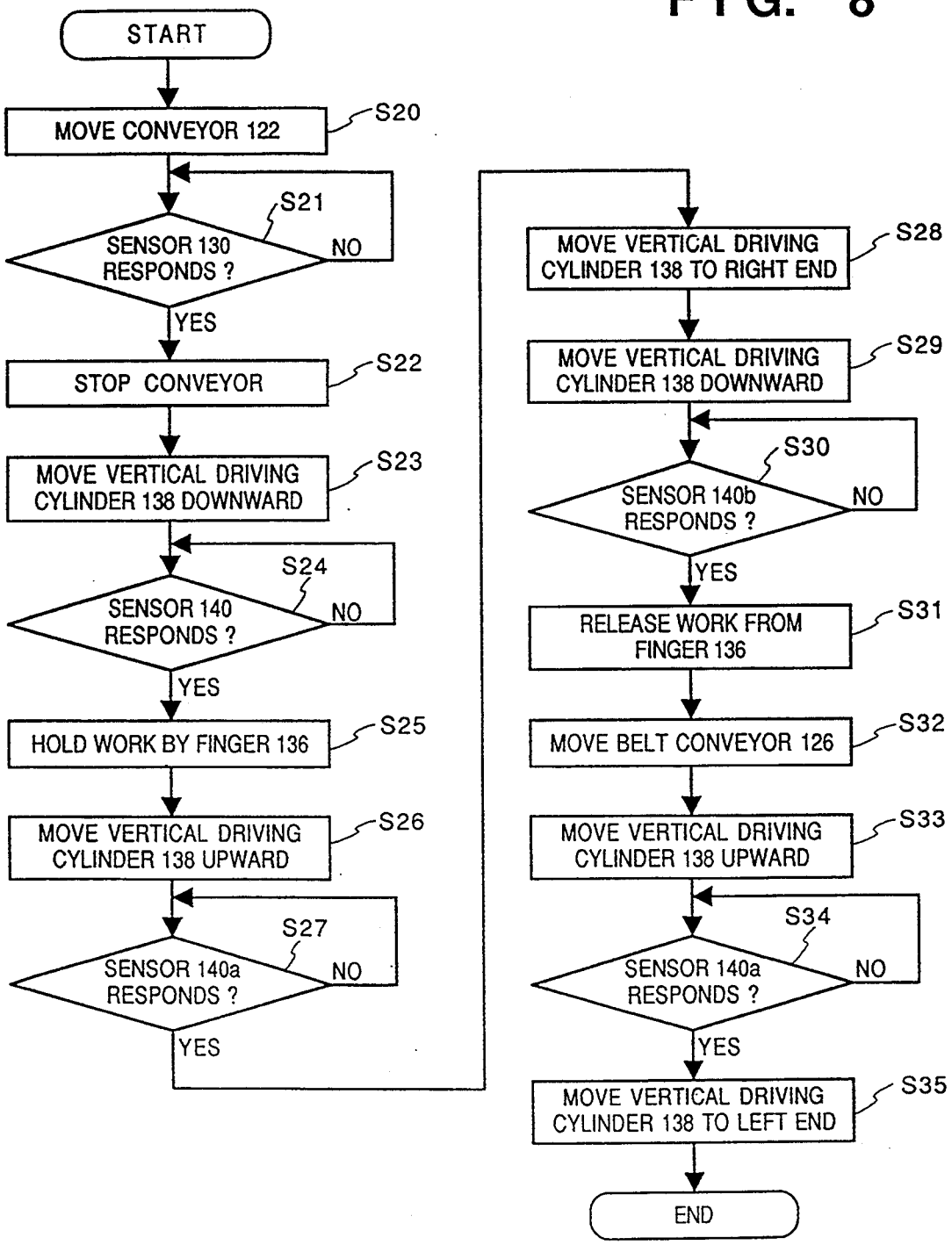
FIG. 8 is a flow chart for explaining a work conveying operation of the auto-hand.

In an initial state, the vertical driving cylinder 138 is located at the left end of the pneumatic cylinder 134, and the finger 136 is located at the upper end of the vertical driving cylinder 138, as shown in FIG. 8.

In step S20, the belt conveyor 122 is driven. When a work W conveyed by the belt conveyor 122 is detected by the sensor 130 in step S21, the belt conveyor 122 is stopped in step S22. In step S23, the finger 136 is moved downward by the vertical driving cylinder 138, and in step S24, the control waits until the sensor **140*b* detects that the finger 136 has reached the lower end. When the sensor 140*b* detects that the finger 136 has reached the lower end, the work W is held by the finger 136 in step S25. In step S26, the finger 136 is moved upward by the vertical driving cylinder 138. In step S27, the control waits until the sensor 140***a* detects that the finger 136 has reached the upper end.

When the sensor 140*a* detects that the finger 136 has reached the upper end, the pneumatic cylinder 134 is driven in step S28, thereby moving the vertical driving cylinder 138 from the left end to the right end of the pneumatic cylinder 134. At this time, the moving operation is controlled according to the flow charts shown in FIGS. 5 and 6 above. More specifically, the deceleration wait time Tw is changed on the basis of, e.g., a change in sliding resistance of a bearing, and the vertical driving cylinder 138 is stopped at the right end of the pneumatic cylinder 134 in a shock-free state.

In step S29, the finger 136 is moved downward by the vertical driving cylinder 138, and in step S30, the control waits until the sensor 140*b* detects that the finger 136 has reached the lower end. When the sensor 140*b* detects that the finger 136 has reached the lower end, the holding state of the work W by the finger 136 is released in step S31. Thus, the work W is transferred from the belt conveyor 122 to the belt conveyor 126.

In step S32, the belt conveyor 126 is driven to convey the work W. In step S33, the finger 136 is moved upward by the vertical driving cylinder 138, and in step S34, the control waits until the sensor 140*a* detects that the finger 136 has reached the upper end.

When the sensor 140*a* detects that the finger 136 has reached the upper end, the pneumatic cylinder 134 is driven in step S35 to move the vertical driving cylinder 138 from the right end to the left end of the pneumatic cylinder 134. Thus, the auto-hand 120 ends its operation.

In the above description, compressed air staying in the air chamber is exhausted to the air simultaneously with the end of movement of the piston of the pneumatic cylinder 134. However, in this auto-hand 120, compressed air in the air chamber may be exhausted immediately after the finger 136 begins, to move upward by the vertical driving cylinder 138 upon completion of holding of the work W. Thus, while the finger holds the work W, the vertical driving cylinder 138 is fixed in position in the horizontal direction, and compressed air staying in the pneumatic cylinder 134 can be exhausted during the upward movement of the finger. Therefore, the pneumatic cylinder 134 can be driven at high speed.

Another application will be described below.

Figure 9:
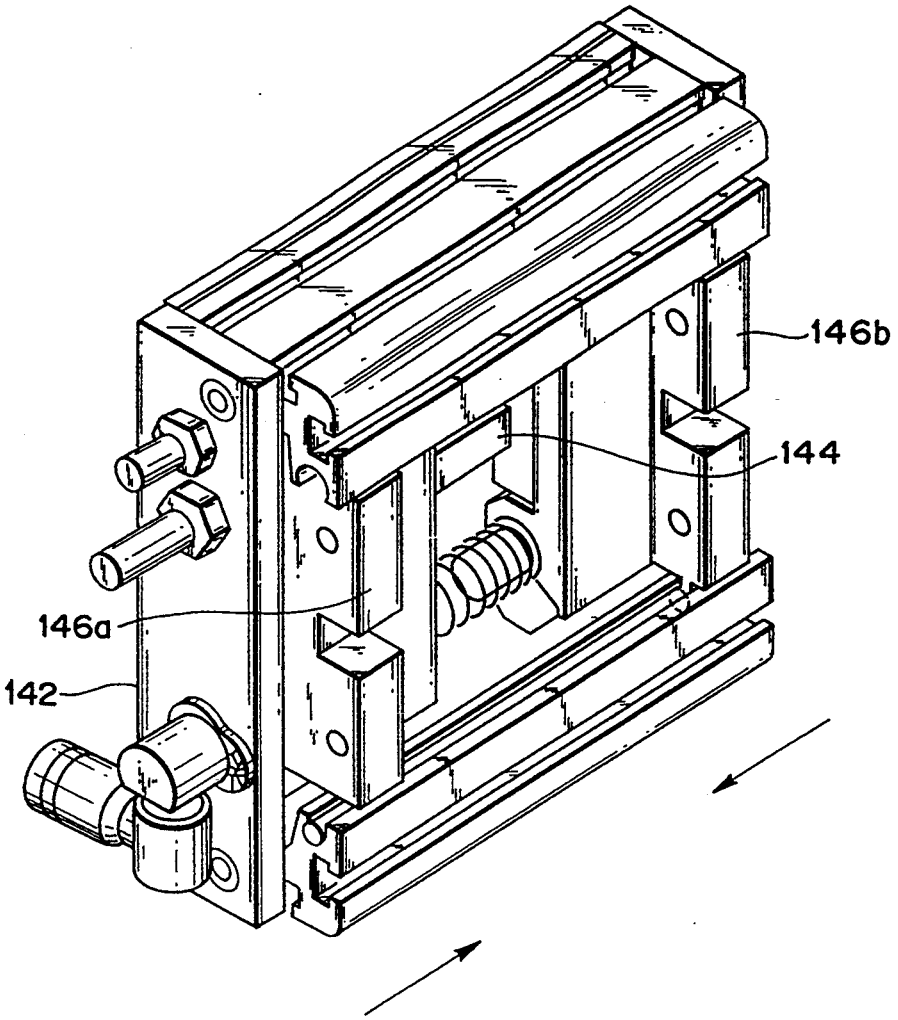
FIG. 9 is a perspective view showing a robot hand which incorporates a cylinder apparatus to which the control method of the first embodiment is applied.

FIG. 9 is a perspective view showing a robot hand to which the cylinder apparatus of the first embodiment is applied. Referring to FIG. 9, a pair of jaws 146*a* and 146*b* are slidably arranged on a robot main body 142 via a guide rail 144. Although not shown, a pneumatic cylinder apparatus adopting the cylinder apparatus of the first embodiment is arranged inside the pair of jaws 146*a* and 146*b*.

Figure 5:
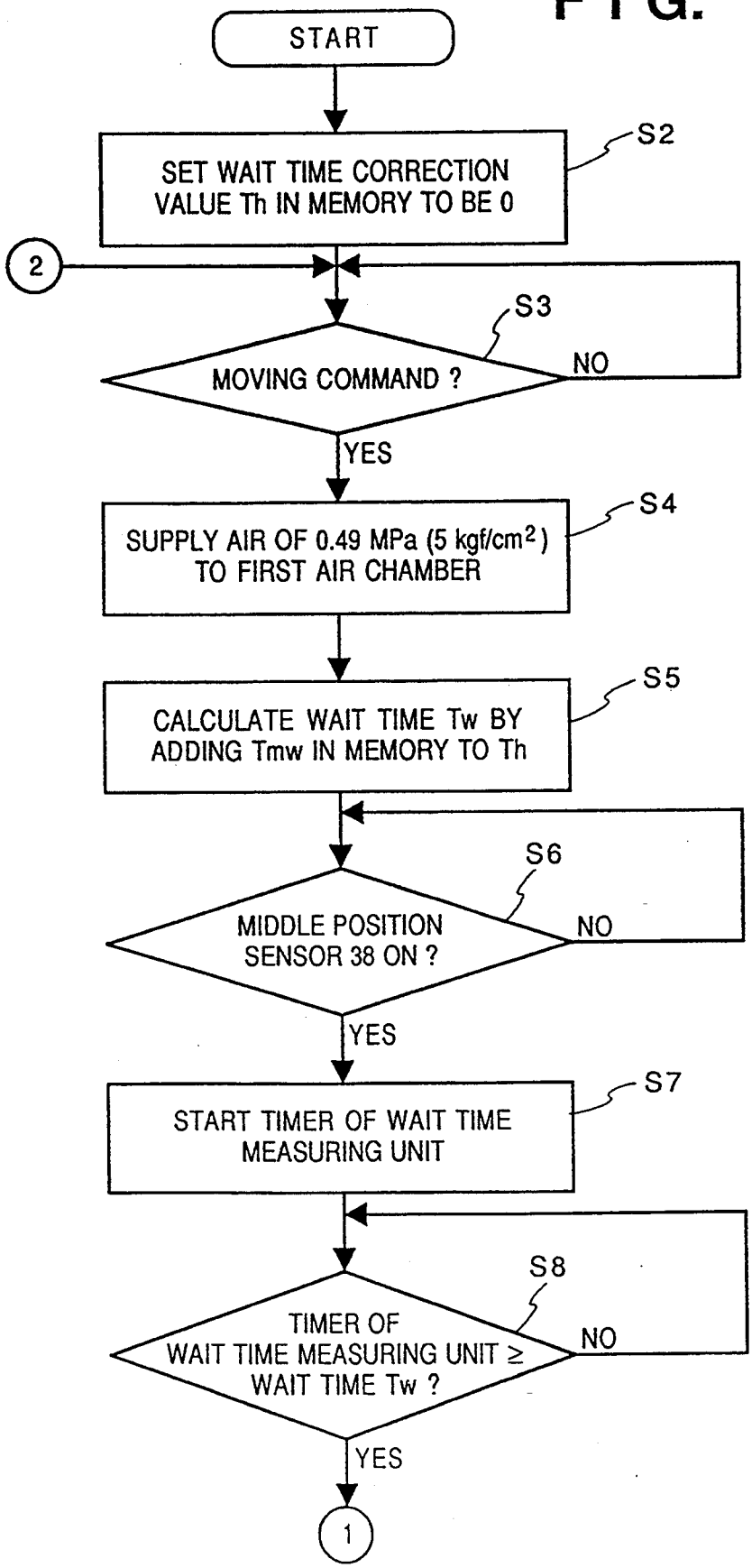
FIG. 5 is a flow chart for explaining an operation for moving a piston.
Figure 6:
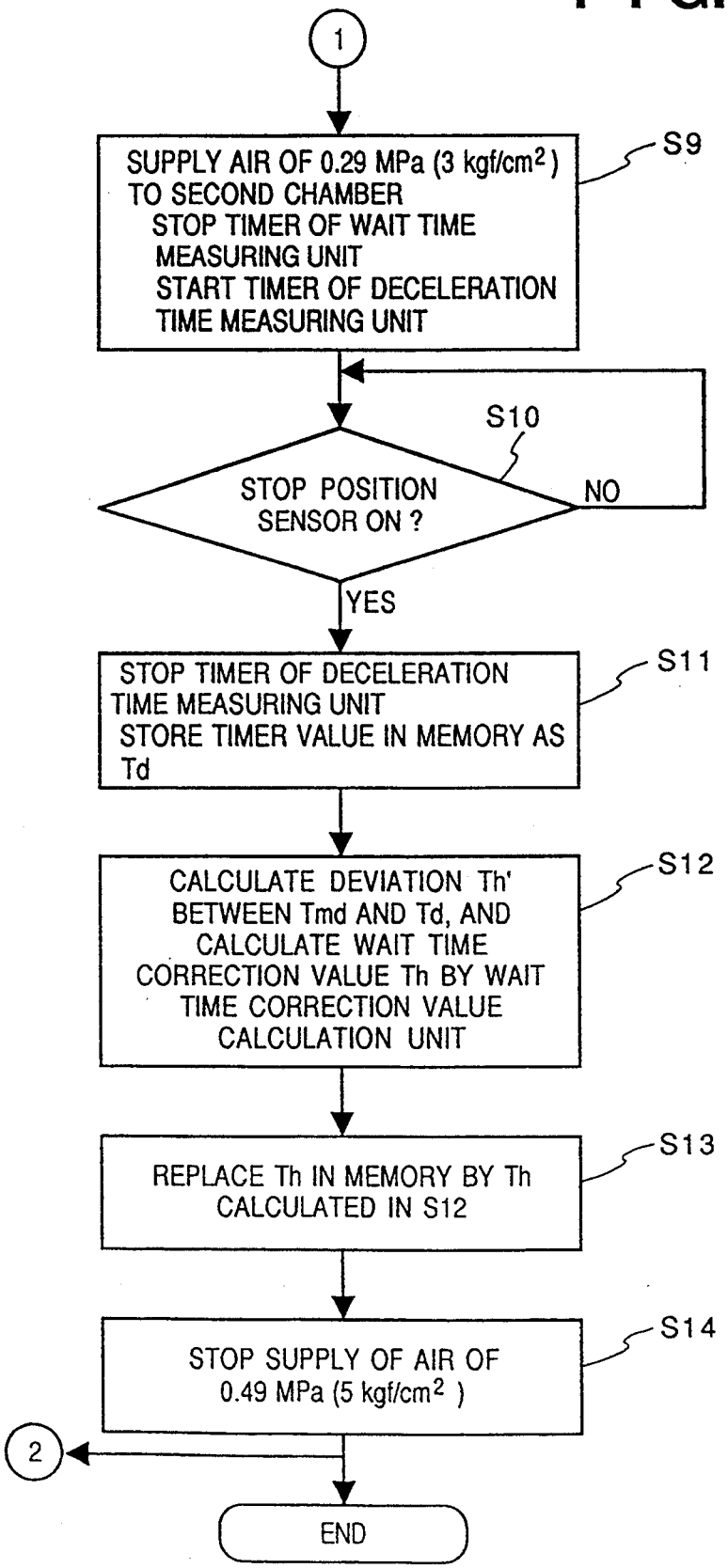
FIG. 6 is a flow chart for explaining the operation for moving the piston.

In this robot hand, when a holding signal is supplied from an external unit, the cylinder apparatus operates according to the flow charts shown in FIGS. 5 and 6 to drive the pair of jaws 146*a* and 146*b* in a direction to approach each other, thus holding a work W. Conversely, when a holding release signal is supplied from an external unit, the cylinder apparatus operates according to the flow charts shown in FIGS. 5 and 6 to drive the pair of jaws 146*a* and 146*b* in a direction to separate from each other, thus releasing the holding state of the work W. When the cylinder apparatus of the first embodiment is applied to such a robot hand, the work W and the jaws can be prevented from receiving a sudden force upon holding of the work, and damages to the work and jaws can be avoided.

(Second Embodiment)

Figure 10:
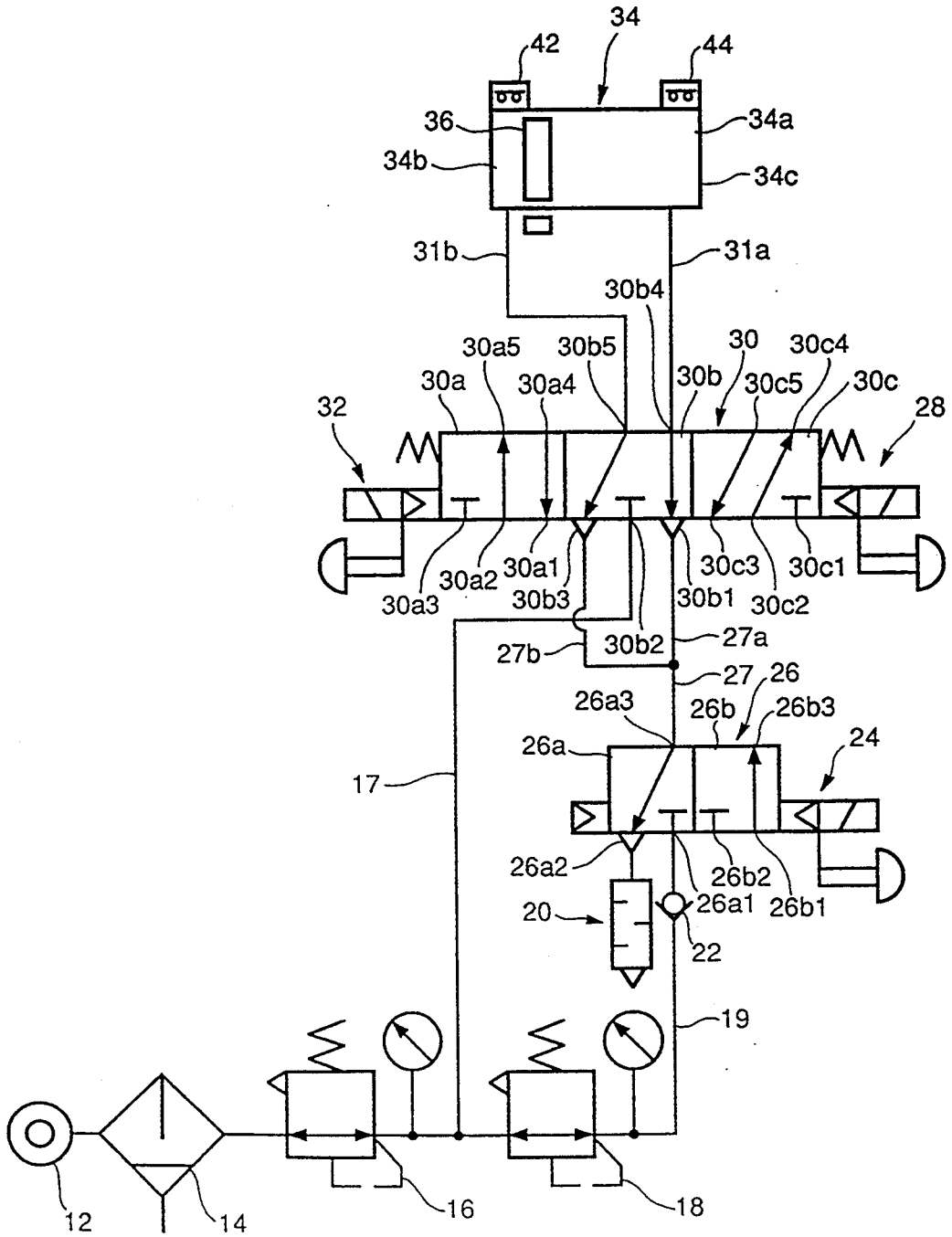
FIG. 10 is a pneumatic pressure circuit diagram showing an arrangement of a cylinder apparatus to which a control method of the second embodiment is applied.
Figure 11:
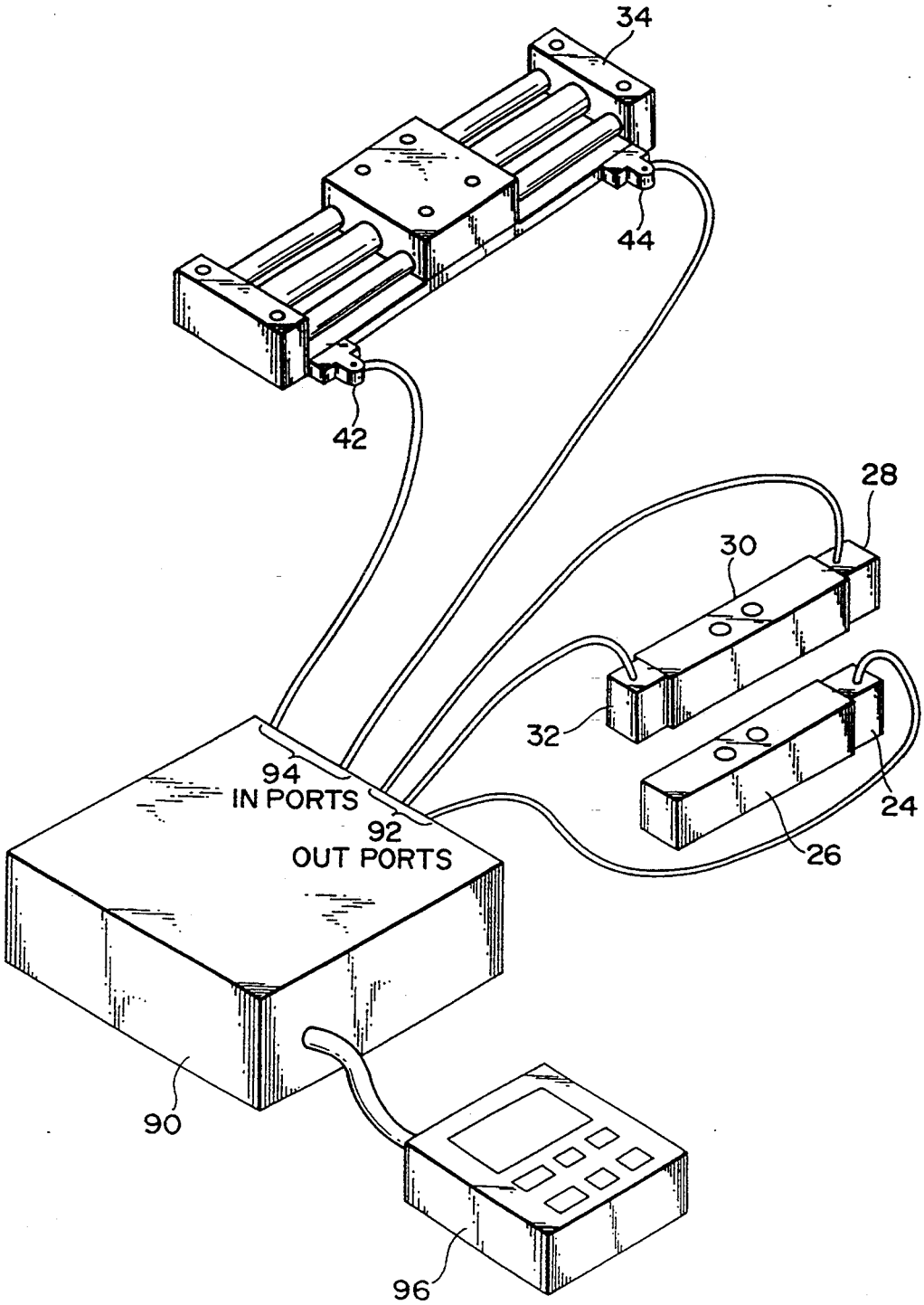
FIG. 11 is a perspective view showing the connection state among a controller, solenoids, and position sensors.

FIG. 10 is a pneumatic circuit diagram showing the arrangement of the second embodiment, and FIG. 11 is a perspective view showing the connection state among a controller, solenoids, and position sensors.

In the second embodiment, the middle position sensors in the first embodiment are omitted, and the number of IN ports of the controller is decreased from four to two. Other arrangements are the same as those in the first embodiment. Therefore, the same reference numerals in this embodiment denote the same parts as in the first embodiment, and a detailed description thereof will be omitted.

Figure 12:
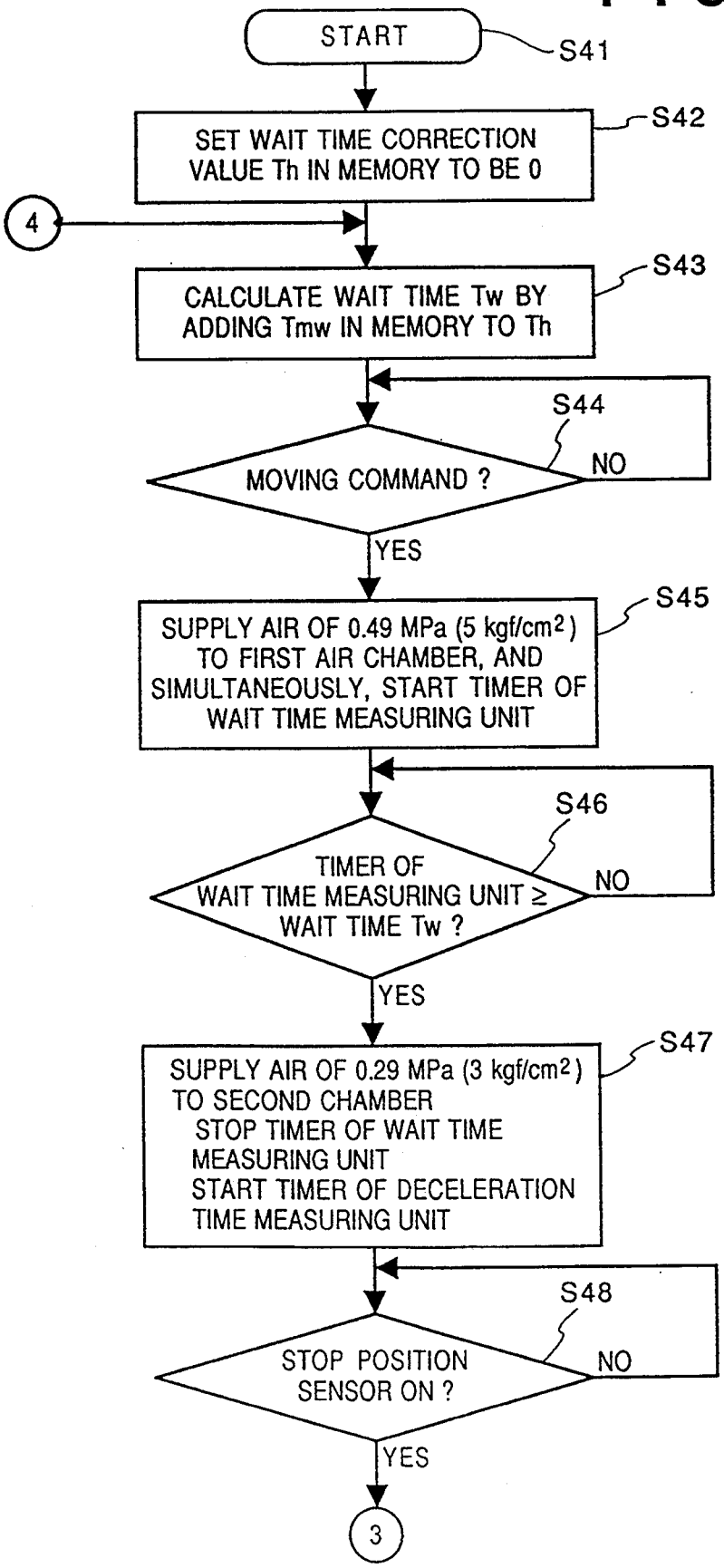
FIG. 12 is a flow chart for explaining an operation for moving a piston.
Figure 13:
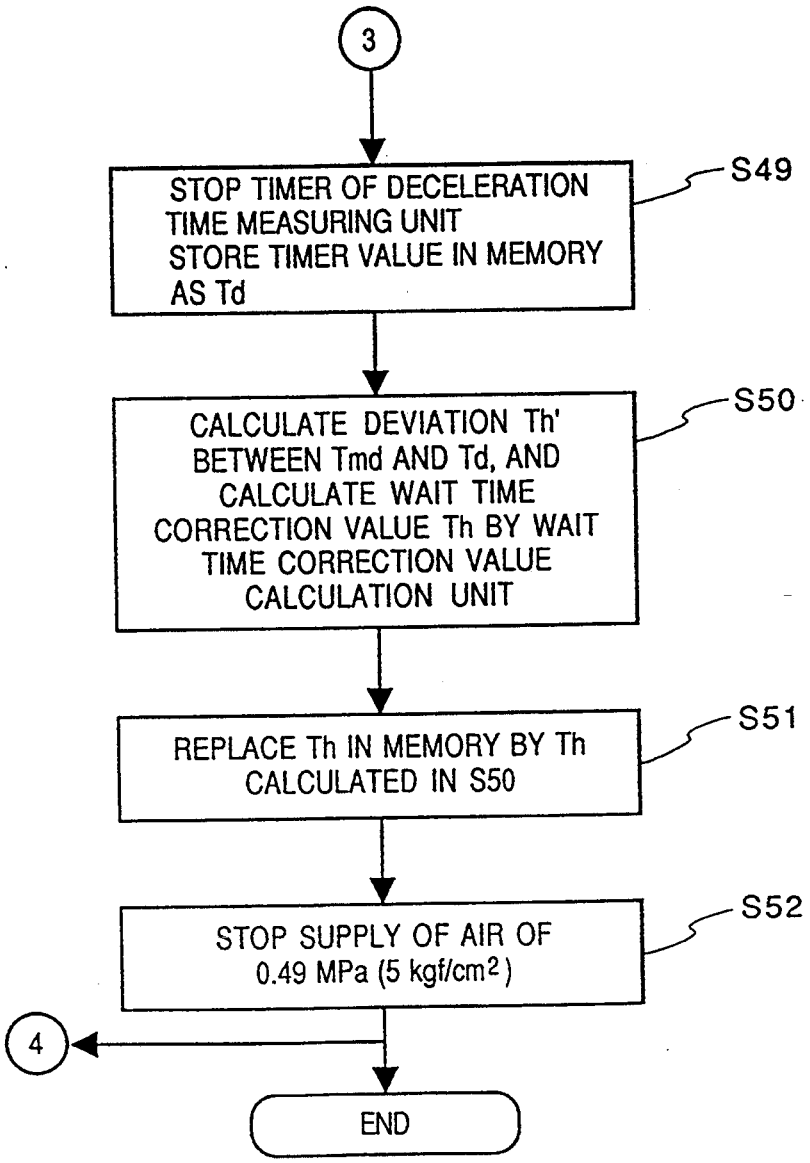
FIG. 13 is a flow chart for explaining the operation for moving the piston.

An operation for moving the piston of the pneumatic cylinder from the right end to the left end in FIG. 10 in the cylinder apparatus with the above arrangement will be described below with reference to the flow charts shown in FIGS. 12 and 13.

As a pre-procedure upon conveying a work in practice by the cylinder apparatus, the target deceleration time Tmd which is a time from the beginning of deceleration to the stop of the piston 36 and which minimizes a shock upon stopping of the piston 36 must be measured as in the first embodiment. The measurement method is the same as that in the first embodiment. However, since the second embodiment does not have the middle position sensor 38 of the first embodiment, a middle position sensor is temporarily attached to measure the target deceleration time Tmd. After the target deceleration time Tmd is measured, this middle position sensor is removed.

Then, an actual work conveying operation is started.

In an initial state, assume that all the solenoids 24, 28, and 32 are set in an OFF state (the state illustrated in FIG. 10), and the piston 36 is located at the right end (FIG. 10) of the pneumatic cylinder main body 34*c*. In this embodiment, the time required for moving the piston 36 from the position of the stop position sensor 44 to the optimal deceleration start position described in the first embodiment will be referred to as a target wait time Tmw (to be described later) hereinafter. More specifically, when the piston 36 begins to brake after an elapse of the target wait time Tmw from an instance of passage of the piston 36 in front of the stop position sensor 44 (i.e., from the instance when the piston 36 begins to move from the right to the left), the piston 36 stops at the end point position in an optimal state. Also, assume that the same additional load (in the above-mentioned case, 3 kgf) as that upon measurement of the target deceleration time is imposed on the piston 36.

Step S41 corresponds to the start step. In step S42, the wait time correction value Th in the memory is set to be 0. The timer value of the timer is reset to 0. In step S43, the target wait time Tmw determined in advance, as described above, and the wait time correction value Th stored in the memory are added to each other, and the sum Tw is stored in the memory. This value Tw will be referred to as a wait time hereinafter. Since Th=0 is initially set, Tw=Tmw.

In step S44, the control waits for a moving command output from the CPU 102. When the moving command is output, the flow advances to step S45. In step S45, the controller 90 outputs a signal for turning on one solenoid 28 of the second solenoid valve 30 from an OUT port 92, and at the same time, starts the timer of the wait time measuring unit 110.

When the solenoid 28 is turned on, the second port 30c2 of the third chamber 30c of the second solenoid valve 30 is connected to the branch communication path 17, and the fourth port 30c4 is connected to the air communication path 31a, thus supplying compressed air of 0.49 MPa (5 kgf/cm$^2$) from the first pressure adjustment apparatus 16 into the first air chamber 34a of the pneumatic cylinder 34. At the same time, the third port 30c3 of the third chamber 30c of the second solenoid valve 30 is connected to the air communication path 27b, and the fifth port 30c5 is connected to the air communication path 31b, thus exhausting air in the second air chamber 34b of the pneumatic cylinder 34 to the air from the muffler 20 via the first solenoid valve 26. Then, the piston 36 begins to move from the right side to the left side with respect to the pneumatic cylinder main body 34c. At this time, as described above, since the air in the second air chamber 34b is released to the air without any resistance, the piston 36 receives almost no counter pressure by the pressure in the second air chamber 34b, and begins to move at a very high speed.

In step S46, the wait time Tw calculated in step S43 is compared with the value of the timer started in step S45, and the control waits until the timer value becomes equal to or larger than the wait time Tw. When the timer value becomes equal to or larger than the wait time Tw, the flow advances to step S47.

In step S47, the timer of the deceleration time measuring unit 112 is started, and the timer of the wait time measuring unit 110 is stopped. At the same time, the controller 90 turns on the solenoid 24 of the first solenoid valve 26. Then, the first port 26b1 of the second chamber 26b of the first solenoid valve 26 is connected to an air communication path 19, and the third port 26b3 is connected to the air communication path 27. As a result, compressed air of 0.29 MPa (3 kgf/cm$^2$) is supplied from the second pressure adjustment device 18 into the second air chamber 34b of the pneumatic cylinder 34. At this time, since the reverse flow of compressed air from the second pressure adjustment device 18 is prevented by the check valve 22, air will never reversely flow from the second air chamber 34b of the pneumatic cylinder, and the pressure in the second air chamber 34b steadily increases. Thus, the piston 36 begins to decelerate.

In step S48, the controller 90 waits until the piston 36 moves to the position of the stop position sensor 42 (the left end position of the pneumatic cylinder main body 34c), the stop position sensor 42 responds, and a detection signal is input from an IN port 94. If the detection signal is input from the IN port 94 in step S48, the flow advances to step S49.

In step S49, the timer of the deceleration time measuring unit 112 is stopped, and this time is stored in the memory 104 as a deceleration time Td. In step S50, a deviation Th' between the target deceleration time Tmd and the deceleration time Td is calculated. When the deviation Th'=0, i.e., when the actual deceleration time Td coincides with the target deceleration time Tmd, it indicates that the piston 36 has stopped at the end point position in a shock-free state, i.e., in an optimal state.

Then, the deviation Th' is multiplied with a predetermined constant Tk (e.g., 1/5). The product is determined to be the wait time correction value Th. When the piston 36 is moved from the right to the left next time, the wait time correction value Th is added to the target wait time Tmw to obtain the actual wait time Tw in step S43. Thus, the deviation between the actual deceleration time Td and the target deceleration time Tmd is fed back to the next operation of the piston 36, and when the moving operation of the piston 36 is repeated several times, the actual deceleration time Td converges to the target deceleration time Tmd. If the deviation Th' is 0, since Th is also 0, the actual wait time Tw is left unchanged in the next movement of the piston 36, and the deceleration of the piston 36 is started at the same timing as the current timing.

The reason why the value of the deviation Th' is not directly used as the wait time correction value Th is as follows. That is, since the frictional resistance or the like of a bearing of the cylinder apparatus slightly changes every time the piston 36 moves, if the deviation Th' is directly used as the wait time correction value Th, the value of the deceleration time Td may not converge to the target deceleration time Tmd. For this reason, when the deviation between the deceleration time Td and the target deceleration time Tmd becomes close to zero but does not easily become zero, the constant Tk is increased. When the deviation oscillates, i.e., when the sign of the deviation changes like +, −, +, −, . . . , the value of the constant Tk is decreased.

In step S51, the value Th stored in the memory 104 is updated with the value of the wait time correction value Th calculated in step S50. The wait time correction value Th stored in the memory 104 is used in the next movement of the piston 36 from the right to the left. In this step, the solenoid 24 of the solenoid valve 26 is turned off. Then, the compressed air to the second air chamber 34b is exhausted to the air.

In step S52, the controller 90 measures an elapsed time from when the stop position sensor 42 responds, and a detection signal is input from the IN port 94. When the elapsed time has reached 0.5 sec, the controller 90 supplies a signal from an OUT port 92 to turn off the solenoid 28 of the second solenoid valve 30. Then, the second solenoid valve 30 is restored to the state illustrated in FIG. 10, and compressed air staying between the first air chamber 34a of the pneumatic cylinder 34 and the second solenoid valve 30 is exhausted to the air from the muffler 20.

In this manner, after an elapse of about 1 sec from when the solenoid 28 is turned off, the pressures in the first and second air chambers 34a and 34b of the pneumatic cylinder 34 become equal to the atmospheric pressure. Thus, the moving operation of the piston 36 from the right end to the left end in FIG. 10 ends.

Note that movement of the piston 36 from the left end to the right end is controlled in the same manner as in the movement from the right end to the left end.

(Third Embodiment)

Figure 14:
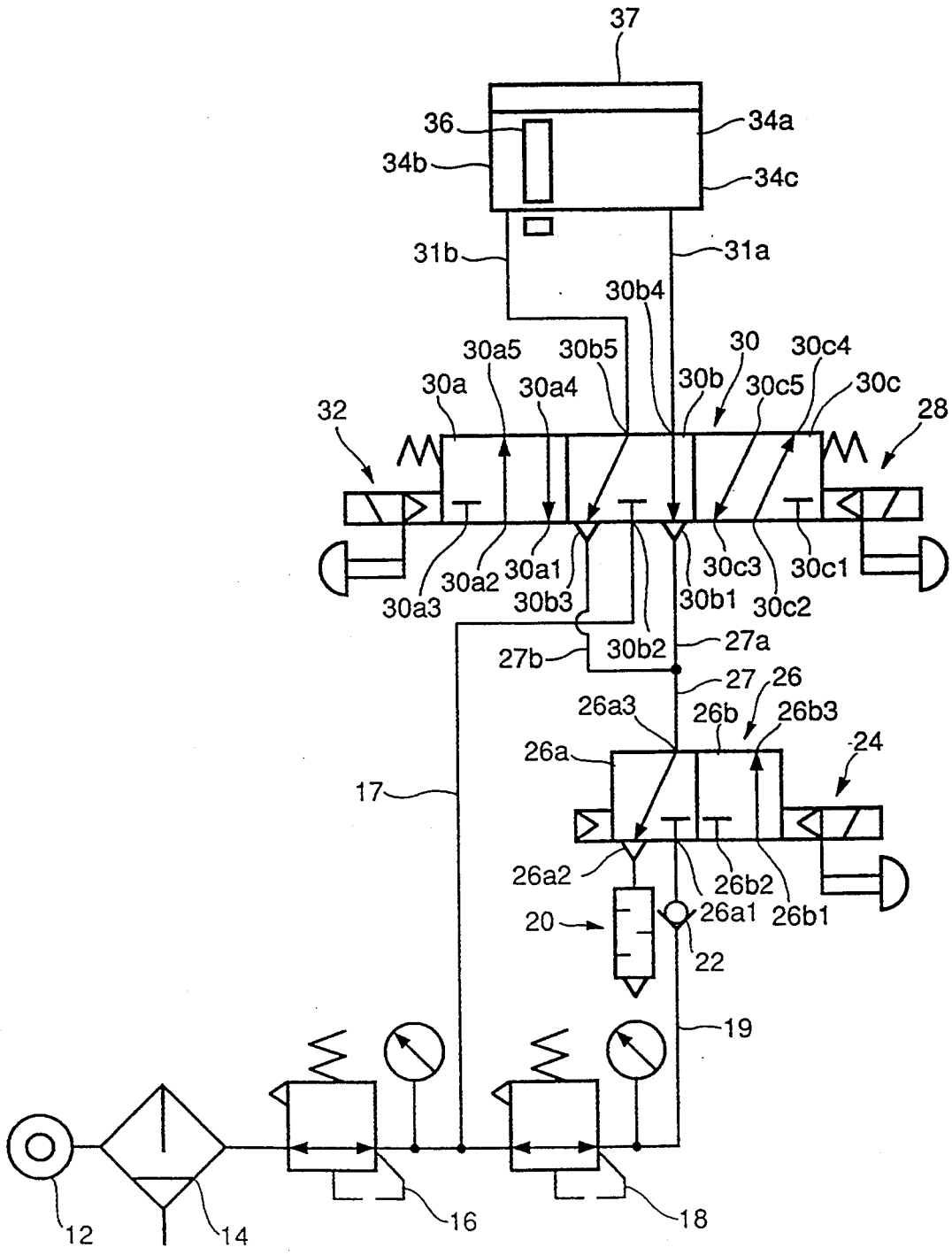
FIG. 14 is a pneumatic pressure circuit diagram showing an arrangement of a cylinder apparatus to which a control method of the third embodiment is applied.
Figure 15:
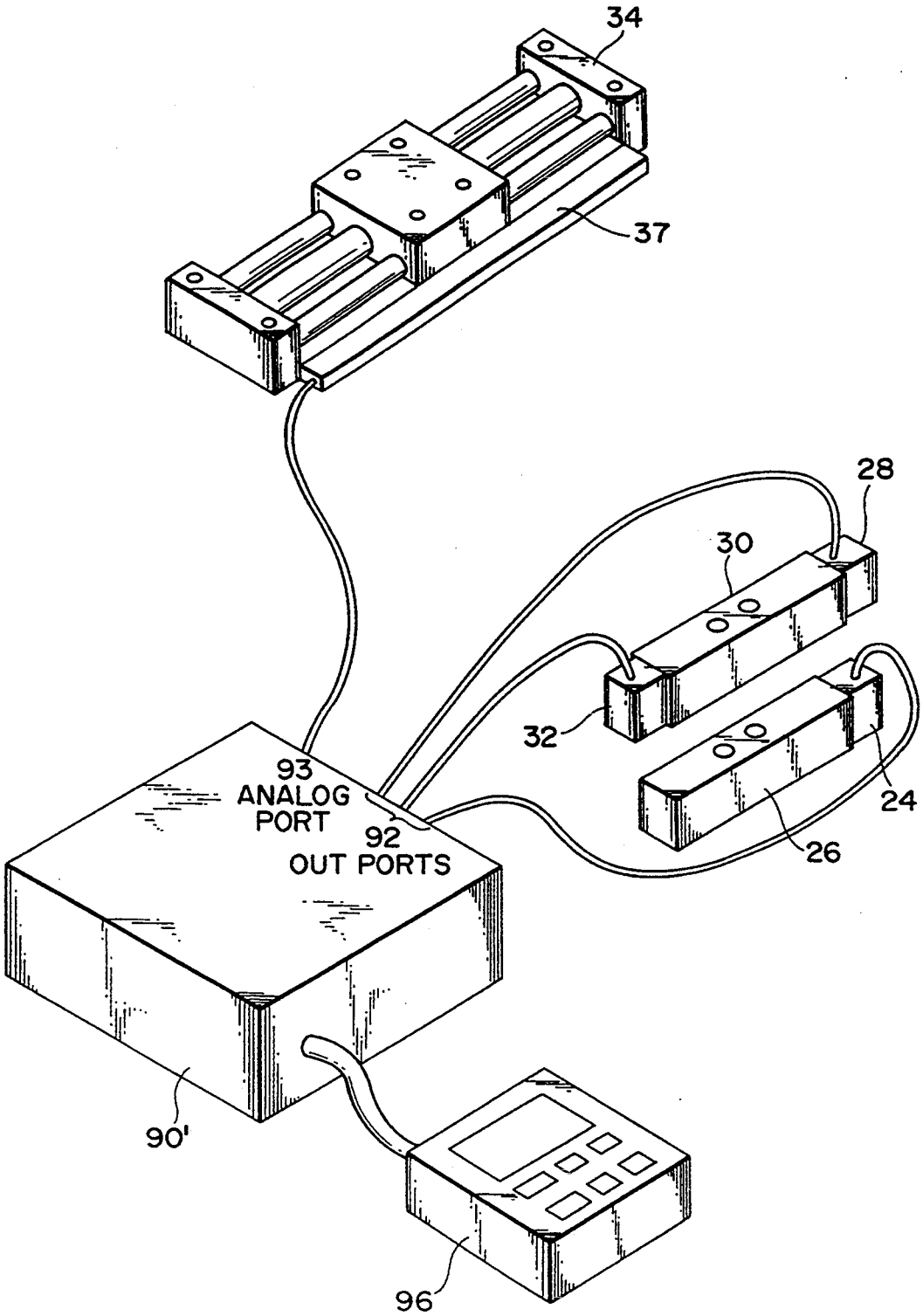
FIG. 15 is a perspective view showing the connection state among a controller, solenoids, and position sensors.
Figure 16:
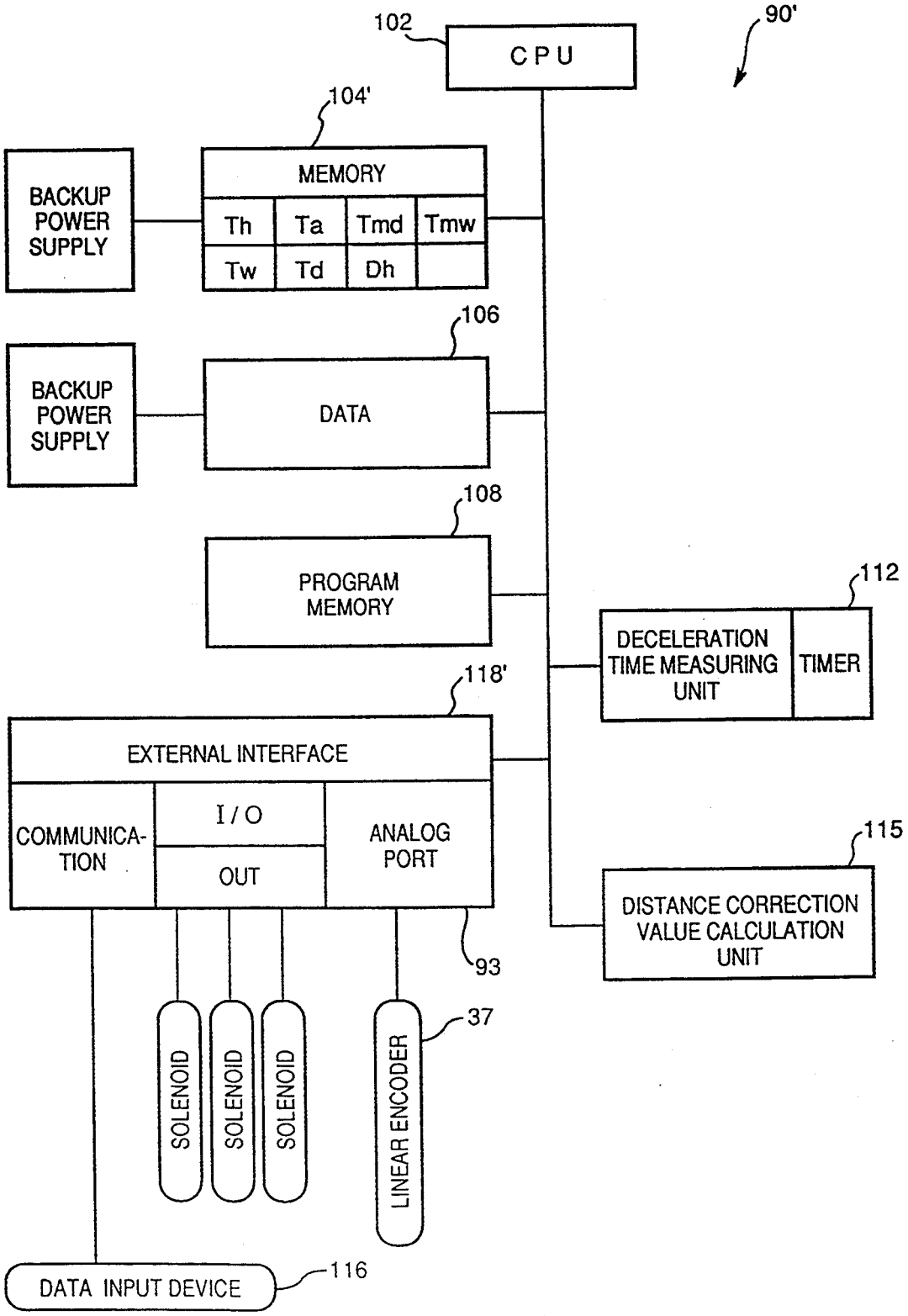
FIG. 16 is a block diagram of a system in the controller.

FIG. 14 is a pneumatic circuit diagram showing the arrangement of the third embodiment, and FIG. 15 is a perspective view showing the connection state among a controller, solenoids, and position sensors. FIG. 16 is a block diagram showing a system in a controller 90'.

In the third embodiment, the middle position sensors and the stop position sensors of the first embodiment are omitted, and a linear encoder 37 for detecting the position of the piston 36 is arranged aside the pneumatic cylinder main body 34c in place of the sensors. In correspondence with this arrangement, the IN ports of the controller 90 are omitted, and an analog port 93 is arranged. As for the arrangement in the controller 90' the wait time measuring unit is omitted, and a distance correction value calculation unit 115 is arranged in place of the wait time correction value calculation unit. Other arrangements are the same as those in the first embodiment. Therefore, the same reference numerals in this embodiment denote the same parts in the first embodiment, and a detailed description thereof will be omitted. Note that components having reference numerals with ′ have the same functions as those denoted by the same reference numerals in the first embodiment, but have slightly different arrangements.

Figure 17:
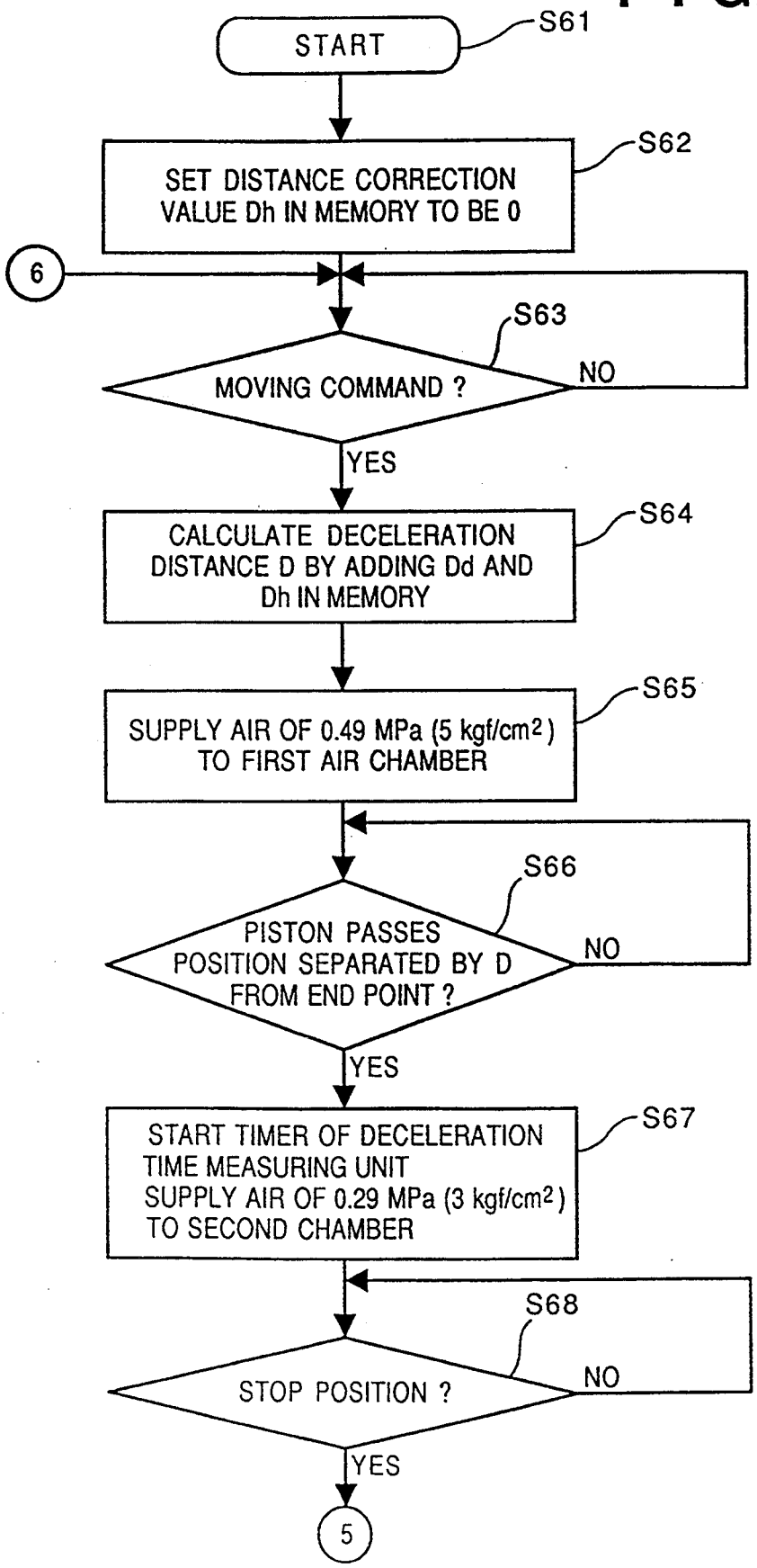
FIG. 17 is a flow chart for explaining an operation for moving a piston.
Figure 18:
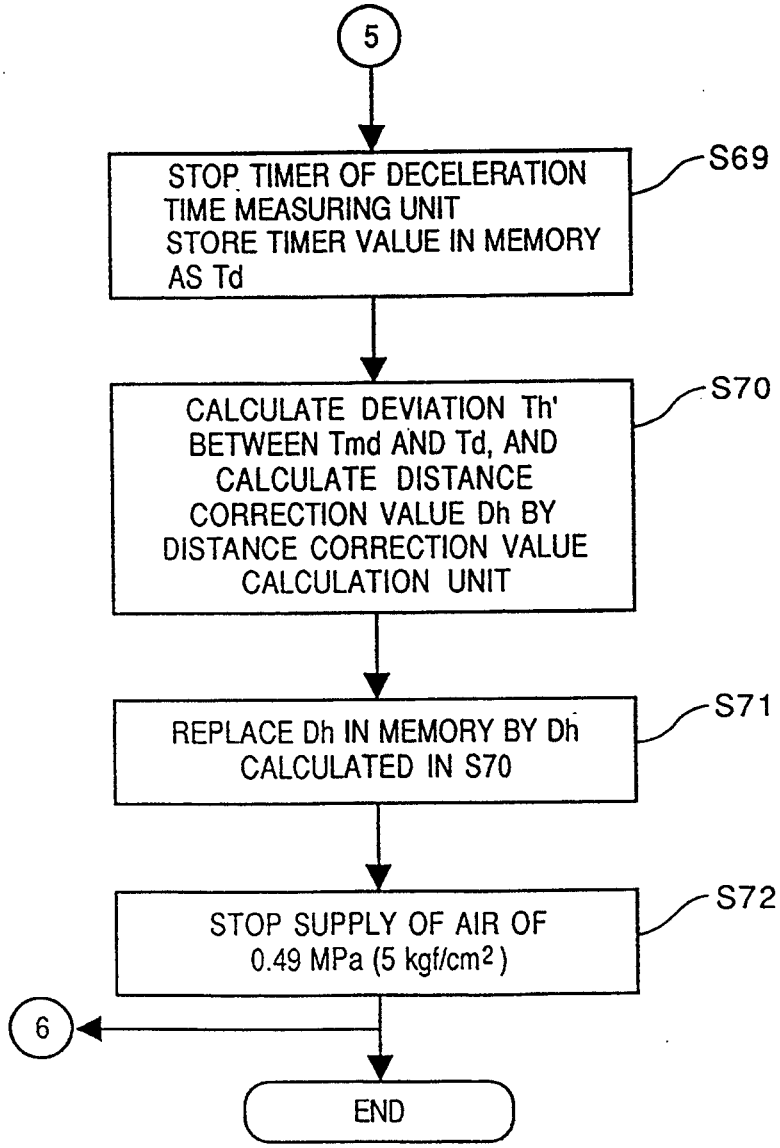
FIG. 18 is a flow chart for explaining the operation for moving the piston.

An operation for moving the piston of the pneumatic cylinder in the cylinder apparatus having the above-mentioned arrangement from the right end to the left end in FIG. 12 will be described below with reference to the flow charts shown in FIGS. 17 and 18.

As a pre-procedure upon conveying, e.g., a work in practice by the cylinder apparatus, a target deceleration distance Dd which is a distance from the beginning of deceleration to the stop of the piston 36 and which minimizes a shock upon stopping of the piston 36 must be measured. Also, a target deceleration time Tmd as the time required from the beginning of deceleration to the stop of the piston 36, i.e., the time required for moving the piston 36 across the target deceleration distance Dd, must be measured at the same time. The measurement procedure will be described below.

In an initial state, assume that all the solenoids 24, 28, and 32 are set in an OFF state (the state illustrated in FIG. 14), and the piston 36 is located at the right end (FIG. 14) of the pneumatic cylinder main body 34*c*.

A weight having the same weight as that of a work as an object to be conveyed, or a work itself is attached to the piston 36 to attain the same state as an actual operation state. In this embodiment, assume that the weight of the work is 3 kgf. In this state, compressed air of 0.49 MPa (5 kgf/cm$^2$) is supplied from the first pressure adjustment device 16 into the first air chamber 34*a* of the pneumatic cylinder 34, and air in the second air chamber 34*b* is exhausted to the air from the muffler 20 via the first solenoid valve 26. Then, the position of the piston 36 is measured by the linear encoder 37. When the piston 36 passes a position near the center of the pneumatic cylinder main body 34*c*, compressed air of 0.29 MPa (3 kgf/cm$^2$) is supplied from the second pressure adjustment device 18 to the second air chamber 34*b*, thereby braking the piston 36. The piston 36 moves toward the end point position at the left end portion of the pneumatic cylinder main body 34*c* while its moving speed is being decelerated, and finally stops.

The stop position is determined by the braking start position of the piston 36. Therefore, depending on the braking start position of the piston 36, the piston 36 may stop before it reaches the end point, may stop just at the end point position, or may not stop before it reaches the end point position, and may collide against the left inner wall of the pneumatic cylinder main body 34*c*. Of these cases, it is most preferable that the piston 36 be stopped just at the end point position.

The deceleration start position of the piston, which position allows the piston 36 to stop just at the end point position, is experimentally obtained while the position of the piston 36 is being measured by the linear encoder 37. In practice, however, since the sliding resistance or the like of a bearing slightly changes every time the piston 36 moves, it is impossible to always stop the piston 36 just at the end point position. When the piston 36 stops before it reaches the end point position, a work or the like as an object to be conveyed cannot be conveyed to the target position, thus posing another problem. For this reason, in practice, an optimal deceleration start position is obtained, so that the piston 36 collides against the end point position with a slight shock, and stops at that position.

In this case, the magnitude of the shock upon collision of the piston 36 against the end point position is determined by detecting the acceleration of the piston 36 at the time of collision or measuring the amplitude of a vibration in the longitudinal direction of the cylinder 34. The deceleration start position of the piston 36 is adjusted to reduce the shock upon collision of the piston 36 as much as possible. This optimal deceleration start position is experimentally determined by repetitively moving the piston 36. The distance from the optimal deceleration start position to the end point position is measured, and is defined to be the target deceleration distance Dd. Also, the time required for moving the piston 36 from the optimal deceleration start position to the end point position is defined to be the target deceleration time Tmd. Even when the sliding resistance or the like changes during the continuous operation of the cylinder apparatus, and the moving speed of the piston 36 changes, if the time from when the piston 36 begins to decelerate until the piston 36 stops coincides with the target deceleration time Tmd, it is experimentally confirmed that the piston 36 has stopped at the end point position in an optimal state.

An operation for moving the piston 36 of the pneumatic cylinder 34 from the right end to the left end (FIG. 13) on the basis of the target deceleration distance Dd and the target deceleration time Tmd, which are measured, as described above, and stopping the piston 36 without any shock will be described below with reference to the flow charts shown in FIGS. 17 and 18.

In an initial state, assume that all the solenoids 24, 28, and 32 are set in an OFF state (the state illustrated in FIG. 14), and the piston 36 is located at the right end (FIG. 14) of the pneumatic cylinder main body 34*c*. Also, assume that the same additional load (in the above-mentioned case, 3 kgf) as that upon measurement of the target deceleration distance and the target deceleration time is imposed on the piston 36.

Step S61 is the start step. In step S62, a distance correction value Dh in the memory is set to be 0. In step S63, the control waits until a moving command is output from the CPU 102. When the moving command is output, the flow advances to step S64. In step S64, the target deceleration distance Dd obtained in advance, as described above, and the distance correction value Dh stored in a memory 104′ are added to each other to calculate a deceleration distance D, and the deceleration distance D is stored in the memory 104′. Since Dh=0 is initially set, D=Dh.

In step S65, the controller 90′ outputs a signal for turning on one solenoid 28 of the second solenoid valve 30 from an OUT port 92 to connect the second port 30*c*2 of the third chamber 30*c* of the second solenoid valve 30 to the branch communication path 17, and to connect the fourth port 30*c*4 to the air communication path 31*a*, thus supplying compressed air of 0.49 MPa (5 kgf/cm$^2$) from the first pressure adjustment device 16 into the first air chamber 34*a* of the pneumatic cylinder 34. At the same time, the third port 30*c*3 of the third chamber 30*c* of the second solenoid valve 30 is connected to the air communication path 27*b*, and the fifth port 30*c*5 is connected to the air communication path 31*b*, thus exhausting air in the second air chamber 34*b* of the pneumatic cylinder 34 to the air from the muffler 20 via the first solenoid valve 26. Then, the piston 36 begins to move from the right side toward the left side with respect to the pneumatic cylinder main body 34*c*. At this time, as described above, since the air in the second air chamber 34*b* is released to the air without any resistance, the piston 36 receives almost no counter pressure by the pressure in the second air chamber 34*b*, and begins to move at a very high speed.

In step S66, the control waits until the piston 36 reaches a position separated from the end point position by the distance D. When the piston 36 has reached the position, the flow advances to step S67. In step S67, the timer of the deceleration time measuring unit 112 is started. At the same time, the controller 90' turns on the solenoid 24 of the first solenoid valve 26. Then, the first port 26*b*1 of the second chamber 26*b* of the first solenoid valve 26 is connected to the air communication path 19, and the third port 26*b*3 is connected to the air communication path 27, thus supplying compressed air of 0.29 MPa (3 kgf/cm$^2$) from the second pressure adjustment device 18 to the second air chamber 34*b* of the pneumatic cylinder 34. At this time, since the reverse flow of compressed air from the second pressure adjustment device 18 is prevented by the check valve 22, air will never reversely flow from the second air chamber 34*b* of the pneumatic cylinder, and the pressure in the second air chamber 34*b* steadily increases. Thus, the piston 36 begins to decelerate.

When the controller 90' detects based on the output signal from the linear encoder 37 in step S68 that the piston 36 has moved to the stop position (the left end position of the pneumatic cylinder main body 34*c*), the flow advances to step S69.

In step S69, the timer of the deceleration time measuring unit 112 is stopped, and this time is stored in the memory 104' as a deceleration time Td. In step S70, a deviation Th' between the above-mentioned target deceleration time Tmd and the deceleration time Td is calculated. When the deviation Th'=0, i.e., when the actual deceleration time Td coincides with the target deceleration time Tmd, it indicates that the piston 36 has stopped at the end point position in a shock-free state, i.e., in an optimal state.

Then, the deviation Th' is multiplied with a predetermined constant Tk (e.g., 1/5×the moving speed of the piston). The product is determined to be the distance correction value Dh. When the piston 36 is moved from the right to the left next time, the distance correction value Dh is added to the target deceleration distance Dd in step S64 to calculate an actual deceleration distance D. Thus, the deviation between the actual deceleration time Td and the target deceleration time Tmd is fed back to the next operation of the piston 36, and when the moving operation of the piston 36 is repeated several times, the actual deceleration time Td converges to the target deceleration time Tmd. If the deviation Th' is 0, since Th is also 0, the deceleration distance D is left unchanged in the next movement of the piston 36, and the deceleration of the piston 36 is started from the same position as that in the current operation.

The reason why a value obtained by multiplying the deviation Th' with the moving speed of the piston is not directly used as the distance correction value Dh is as follows. That is, since the frictional resistance or the like of a bearing of the cylinder apparatus slightly changes every time the piston 36 moves, if the value obtained by multiplying the deviation Th' with the moving speed of the piston is directly used as the distance correction value Dh, the value of the deceleration time Td may not converge to the target deceleration time Tmd. For this reason, when the deviation between the deceleration time Td and the target deceleration time Tmd becomes close to zero but does not easily become zero, the constant Tk is increased. When the deviation oscillates, i.e., when the sign of the deviation changes like +, −, +, −, . . . , the value of the constant Tk is decreased.

In step S71, the value Dh stored in the memory 104' is updated with the value of the distance correction value Dh calculated in step S70. The distance correction value Dh stored in the memory 104' is used in the next movement of the piston 36 from the right end to the left end. In this step, the solenoid 24 of the solenoid valve 26 is turned off. Then, the compressed air to the second air chamber 34*b* is exhausted to the air.

In step S72, the controller 90' measures an elapsed time from when the linear encoder 37 detects that the piston 36 has reached the end point position. When this elapsed time has reached 0.5 sec, the controller 90' supplies a signal from an OUT port 92 to turn off the solenoid 28 of the second solenoid valve 30. Then, the second solenoid valve 30 is restored to the state illustrated in FIG. 14, and compressed air staying between the first air chamber 34*a* of the pneumatic cylinder 34 and the second solenoid valve 30 is exhausted to the air from the muffler 20.

In this manner, after an elapse of about 1 sec from when the solenoid 28 is turned off, the pressures in the first and second air chambers 34*a* and 34*b* of the pneumatic cylinder 34 become equal to the atmospheric pressure. Thus, the moving operation of the piston 36 from the right end to the left end in FIG. 14 ends.

Note that movement of the piston 36 from the left end to the right end is controlled in the same manner as in the movement from the right end to the left end.

In this embodiment, a moving command is output to actually move the piston, a distance correction value Dh is calculated to eliminate the deviation between a deceleration time Td measured at that time and a target deceleration time Tmd, and the correction value Dh is added to a target deceleration distance Dd in the next moving operation. Thus, even when the sliding resistance or the like of a bearing of the cylinder apparatus changes as time elapses, the piston can be smoothly stopped all the time.

(Fourth Embodiment)

Figure 19:
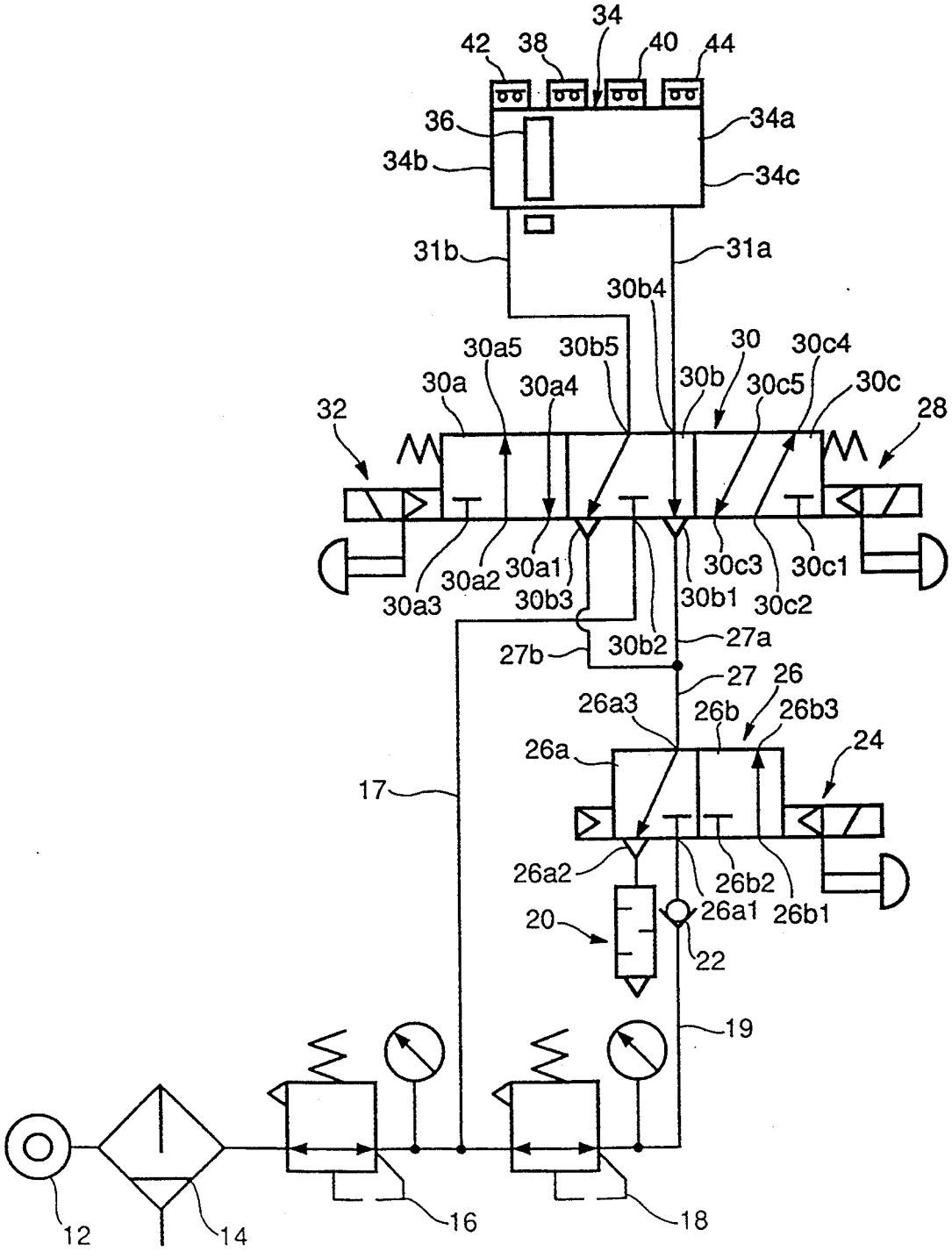
FIG. 19 is a pneumatic pressure circuit diagram showing an arrangement of a cylinder apparatus to which a control method of the fourth embodiment is applied.
Figure 20:
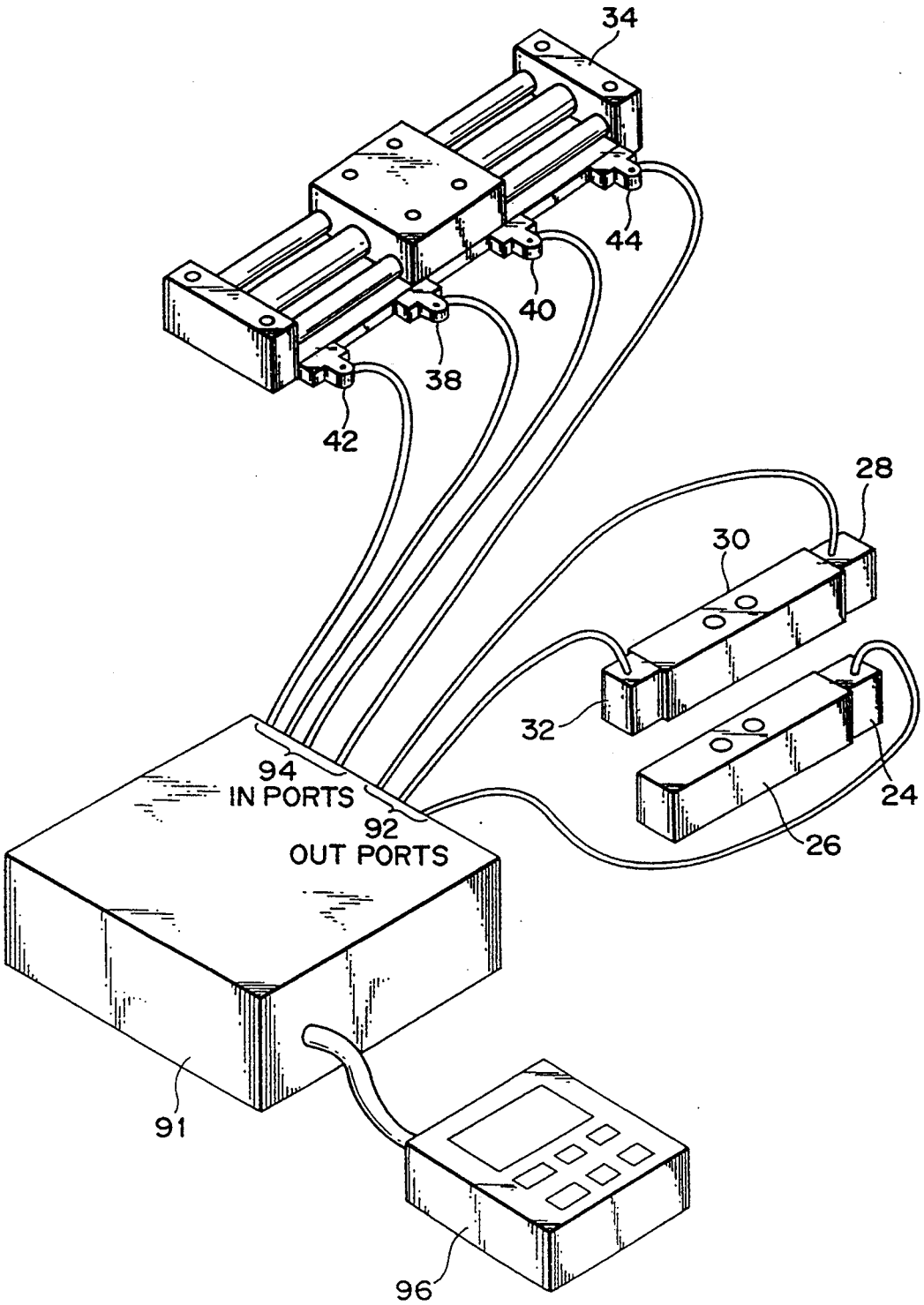
FIG. 20 is a perspective view showing the connection state among a controller, solenoids, and position sensors.
Figure 21:
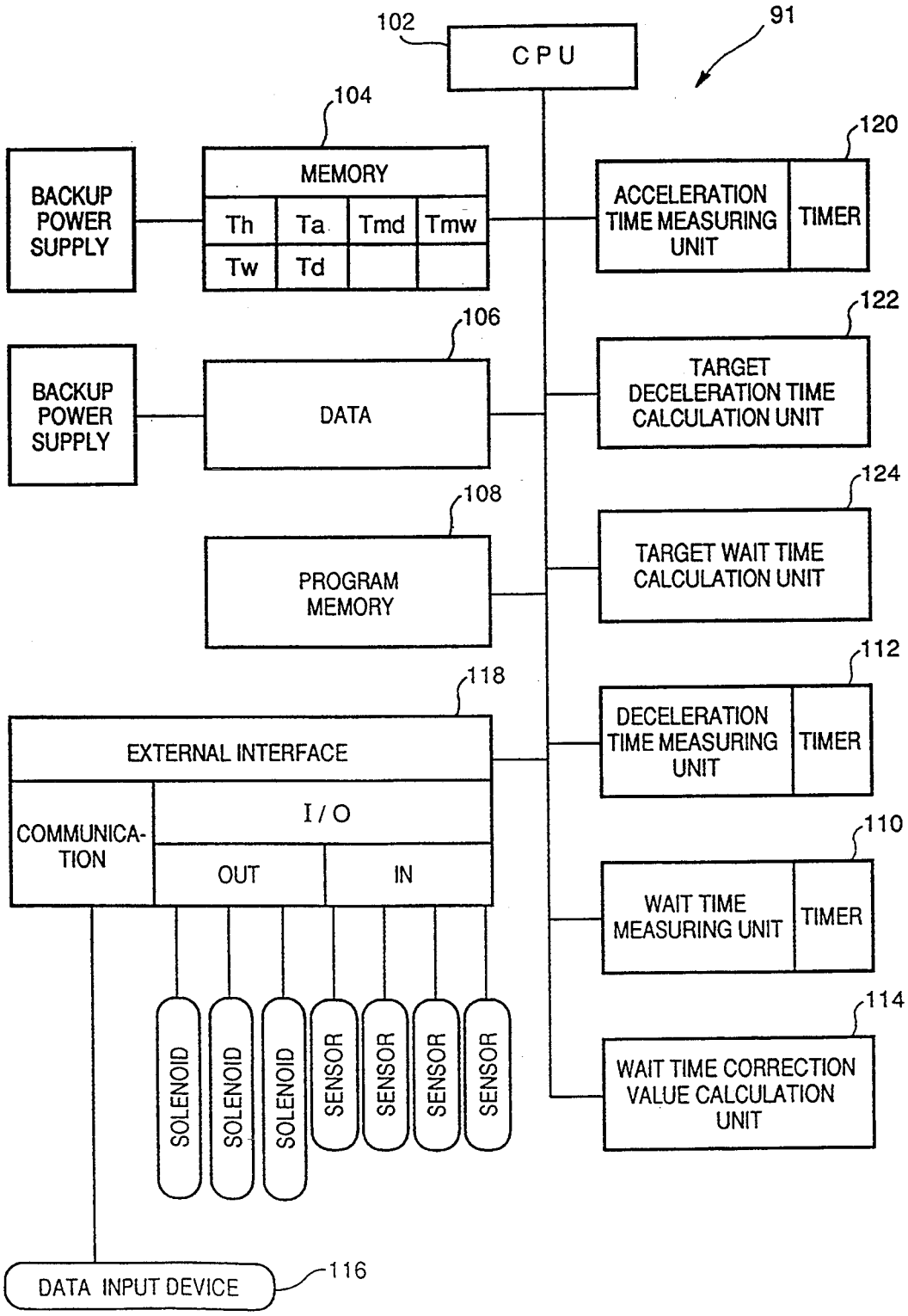
FIG. 21 is a block diagram of a system in the controller.

FIG. 19 is a pneumatic circuit diagram showing the arrangement of the fourth embodiment, and FIG. 20 is a perspective view showing the connection state among a controller, solenoids, and position sensors. FIG. 21 is a block diagram showing a system in a controller 91.

In the fourth embodiment, the arrangements shown in FIGS. 19 and 20 are the same as those in the first embodiment. Therefore, the same reference numerals in this embodiment denote the same parts as in the first embodiment, and a detailed description thereof will be omitted. However, since a controller in FIG. 20 has an internal arrangement different from that of the first embodiment, it will be denoted by reference numeral 91 to be distinguished from the controller in the first embodiment.

As for the system arrangement in the controller 91, an acceleration time measuring unit 120, a target deceleration time calculation unit 122, and a target wait time calculation unit 124 are added to the arrangement of the first embodiment.

The acceleration time measuring unit 120 measures an acceleration time Ta as the time required from when the CPU 102 outputs a moving command signal for moving the piston 36 or when the stop position sensor 42 or 44 attached to a corresponding one of the two end portions of the pneumatic cylinder main body 34*c* detects that the piston 36 begins to move until the piston 36 moves to the position of the next middle position sensor 38 or 40. The acceleration time measuring unit 120 comprises at least one independent timer.

The target deceleration time calculation unit 122 calculates a target deceleration time Tmd on the basis of the acceleration time Ta measured by the acceleration time measuring unit 120.

The target wait time calculation unit 124 calculates a target wait time Tmw on the basis of the acceleration time Ta measured by the acceleration time measuring unit 120.

The operation of the cylinder apparatus with the above arrangement will be described below.

As a pre-procedure upon conveying, e.g., a work in practice by the cylinder apparatus, a target deceleration time Tmd which is a time required from the beginning of deceleration to the stop of the piston 36 and which minimizes a shock upon stopping of the piston 36 must be measured.

In the first embodiment, when the target deceleration time Tmd is measured in a state wherein a load (a load weight) of, e.g., 3 kgf is imposed on the piston 36, this value Tmd can only be used when a work of 3 kgf is conveyed. For this reason, when a work of another weight is to be conveyed, the target deceleration time Tmd must be measured again from the beginning.

In contrast to this, in the fourth embodiment, even when the load weight imposed on the piston 36 changes, a target deceleration time Tmd corresponding to the load can be predicted. More specifically, the value of the acceleration time Ta is measured for at least two different load weights (e.g., 3 kgf and 7 kgf), and target deceleration times Tmd for stopping the piston 36 at the end point position without any shock are simultaneously obtained in correspondence with these load weights. That is, a combination of the acceleration time Ta and the target deceleration time Tmd is measured for each of the two different load weights. A target deceleration time Tmd3 when an intermediate load weight (e.g., 5 kgf) between the two different load weights is imposed on the piston is predicted from an acceleration time Ta3 when the load weight of 5 kgf is imposed on the piston, on the basis of at least two combinations (Ta1, Tmd1) and (Ta2, Tmd2) of the acceleration times and the target deceleration times.

First, an acceleration time Ta3 when an intermediate load weight (5 kgf in the above case) is imposed on the piston is measured. The already measured two combinations (Ta1, Tmd1) and (Ta2, Tmd2) of the acceleration times and the target deceleration times are considered as coordinate points on a graph, and these two points are linearly approximated, thereby calculating a target deceleration time Tmd3 corresponding to the acceleration time Ta3. In this manner, even when the load weight imposed on the piston 36 changes, a target deceleration time can be predicted. When the combination of the acceleration time Ta and the target deceleration time Tmd is calculated in correspondence with three or more different load weights, three or more points on a graph can be calculated. When a curve passing these points is calculated by a least square approximation formula, the target deceleration time Tmd can be calculated more precisely.

A detailed procedure for measuring the combination of the acceleration time Ta and the target deceleration time Tmd in correspondence with a plurality of different load weights will be described below.

In an initial state, assume that all the solenoids 24, 28, and 32 are set in an OFF state (the state illustrated in FIG. 19), and the piston 36 is located at the right end (FIG. 19) of the pneumatic cylinder main body 34*c*.

A load weight of, e.g., 3 kgf is imposed on the piston 36 (for example, a weight of 3 kgf is attached to the piston 36). In this state, compressed air of 0.49 MPa (5 kgf/cm$^2$) is supplied from the first pressure adjustment device 16 into the first air chamber 34*a* of the pneumatic cylinder 34, and air in the second air chamber 34*b* is exhausted to the air from the muffler 20 via the first solenoid valve 26. Thus, the piston 36 begins to move from the right end toward the left end of the pneumatic cylinder main body 34*c*. Then, the time required from when the piston 36 begins to move until the piston 36 passes in front of the middle position sensor 40, i.e., the acceleration time Ta, is measured. Simultaneously with passage of the piston 36 in front of another middle position sensor 38, compressed air of 0.29 MPa (3 kgf/cm$^2$) is supplied from the second pressure adjustment device 18 to the second air chamber 34*b*, thus braking the piston 36. At this time, the middle position sensor 38 is attached to a proper position of the pneumatic cylinder main body 34*c*. When the piston 36 is braked, the piston 36 moves toward the end point position at the left end position of the pneumatic cylinder main body 34*c* while being decelerated, and finally stops.

The stop position is determined by the braking start position of the piston 36, i.e., the position, in the right-and-left direction in FIG. 19, of the middle position sensor 38. Therefore, depending on the attached position of the middle position sensor 38, the piston 36 may stop before it reaches the end point, may stop just at the end point position, or may not stop before it reaches the end point position, and may collide against the left inner wall of the pneumatic cylinder main body 34*c*. Of these cases, it is most preferable that the piston 36 be stopped just at the end point position.

The position of the middle position sensor 38 is experimentally obtained, so that the piston 36 stops just at the end point position. In practice, however, since the sliding resistance or the like of a bearing slightly changes every time the piston 36 moves, it is impossible to always stop the piston 36 just at the end point position. When the piston 36 stops before it reaches the end point position, a work or the like as an object to be conveyed cannot be conveyed to the target position, thus posing another problem. For this reason, in practice, the position of the middle position sensor 38 is adjusted, so that the piston 36 collides against the end point position with a slight shock, and stops at that position.

In this case, the magnitude of the shock upon collision of the piston 36 against the end point position is determined by detecting the acceleration of the piston 36 at the time of collision or measuring the amplitude of a vibration in the longitudinal direction of the cylinder 34. The position of the middle position sensor 38 is adjusted so as to reduce the shock upon collision of the piston 36 as much as possible. The position adjustment of the middle position sensor 38 is experimentally attained by repetitively moving the piston 36. In a state wherein the position of the middle position sensor 38 is adjusted to an optimal deceleration start position, as described above, the piston 36 is moved, the time from an instance when the piston 36 passes in front of the middle position sensor 38 (from this instance, the piston 36 begins to decelerate) until the piston is stopped is measured, and the measured time is determined to be the target deceleration time Tmd.

In this manner, the acceleration time Ta1 and the target deceleration time Tmd1 corresponding to one load weight (i.e., the load weight of 3 kgf) are measured. Then, the acceleration time Ta2 and the target deceleration time Tmd2 corresponding to the other load weight (e.g., 7 kgf) are measured by the same method. Note that the measurement operations of these times are performed under an identical cylinder condition in a no-load state. When the combination of the acceleration time and the target deceleration time is measured in correspondence with a larger number of different load weights, prediction precision of the target deceleration time can be improved.

A relation between the acceleration time Ta and the target deceleration time Tmd for each load weight, which are measured, as described above, is obtained as an n-th order least square approximation formula (n is the number of measured load weights). If the obtained relation is represented by Fmd, the target deceleration time Tmd is given by:

$$Tmd = Fmd(Ta)$$

The target deceleration time calculation unit 122 calculates the target deceleration time Tmd from the value of the acceleration time Ta in accordance with this function.

A method of calculating the target wait time Tmw will be described below. After the target deceleration time Tmd is measured on the basis of a plurality of different load weights, the middle position sensor 38 is fixed to the pneumatic cylinder main body 34*c*. Assume that the fixing position is a position slightly offset from the above-mentioned optimal deceleration start position to the right side in FIG. 19. In this state, the load weight is set to be, e.g., 3 kgf, and an acceleration time Ta1, and a target wait time Tmw1 from an instance of passage of the piston 36 in front of the middle position sensor 38 to the optimal deceleration position are measured. Similarly, the load weight is set to be, e.g., 7 kgf, and an acceleration time Ta2 and a target wait time Tmw2 are measured.

Then, a relation between the acceleration time Ta and the target wait time Tmw for each load weight, which are measured, as described above, is obtained as an n-th order least square approximation formula. If the obtained relation is represented by Fmw, the target wait time Tmw is given by:

$$Tmw = Fmw(Ta)$$

The above-mentioned target wait time calculation unit 124 calculates the target weight time Tmw from the value of the acceleration time Ta in accordance with this function. Upon calculation of the function Fmw, when the values of the acceleration time Ta and the target wait time Tmw are calculated for a larger number of different load weights, an approximation function with higher precision can be obtained in the same manner as the function used for calculating the target deceleration time Tmd. Note that the functions Fmd and Fmw, which are calculated, as described above, are stored in the controller.

Figure 22:
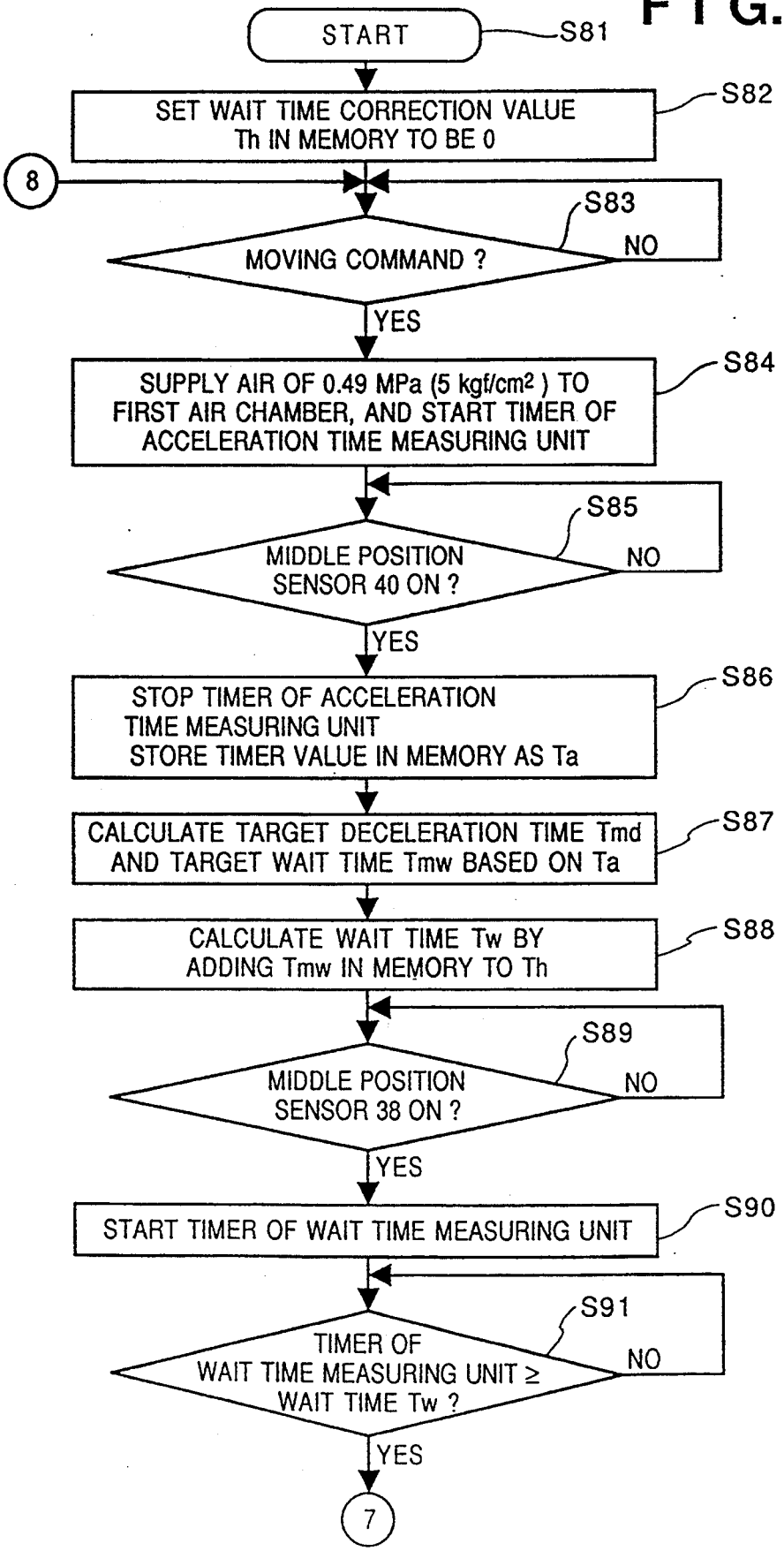
FIG. 22 is a flow chart for explaining an operation for moving a piston.
Figure 23:
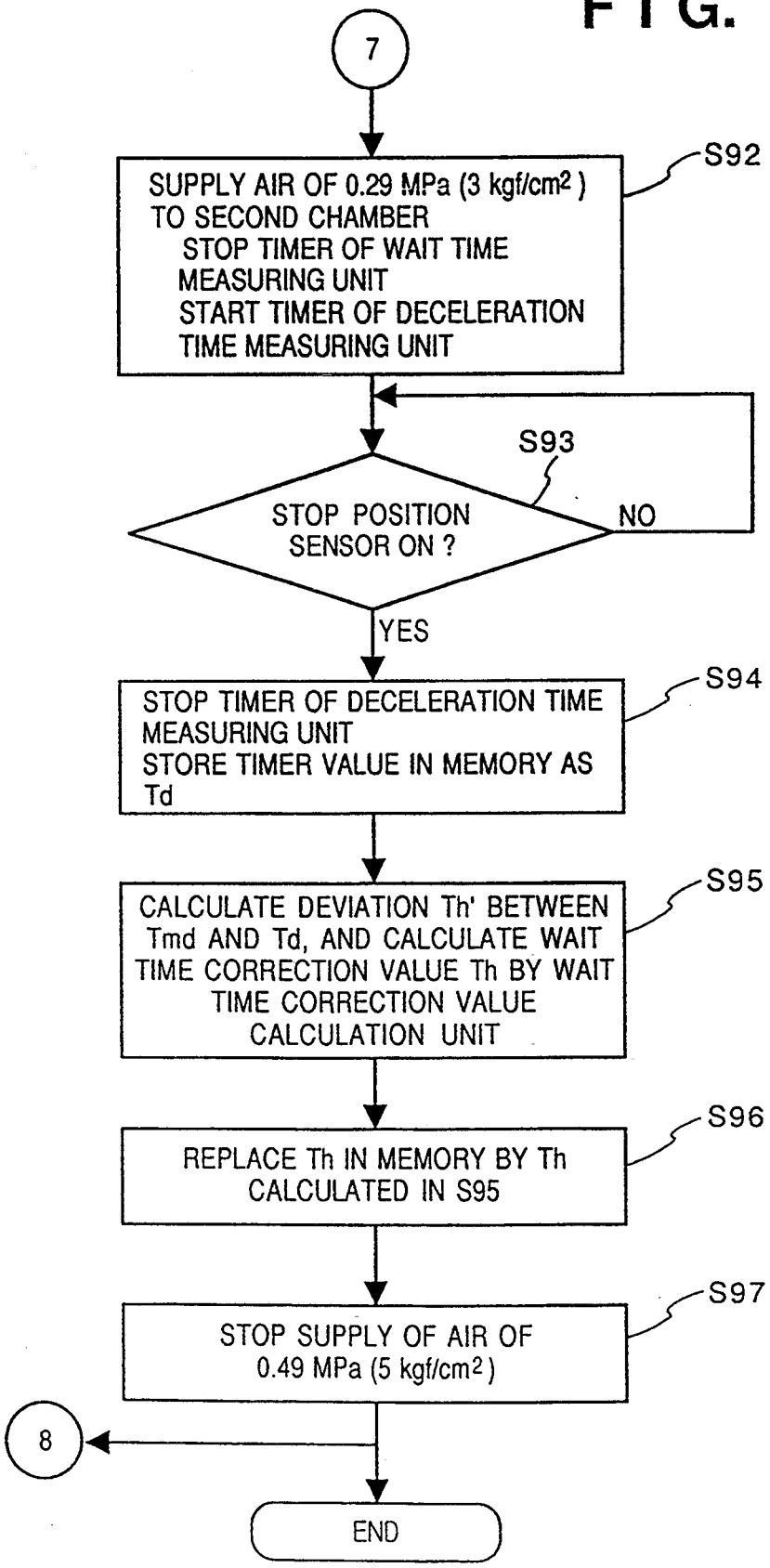
FIG. 23 is a flow chart for explaining the operation for moving the piston.

An operation for moving the piston 36 of the pneumatic cylinder 34 from the right end to the left end (FIG. 19) on the basis of the functions which are calculated, as described above, and stopping the piston 36 without any shock will be described below with reference to the flow charts shown in FIGS. 22 and 23.

In an initial state, assume that all the solenoids 24, 28, and 32 are set in an OFF state (the state illustrated in FIG. 19), and the piston 36 is located at the right end (FIG. 19) of the pneumatic cylinder main body 34*c*. Also, assume that the middle position sensor 38 is arranged at a position slightly offset from the above-mentioned optimal deceleration start position to the right side.

Step S81 is the start step. In step S82, a wait time correction value Th in the memory is set to be 0. The timer value of a timer is reset to 0. In step S83, the control waits for a moving command output from the CPU 102. When the moving command is output, the flow advances to step S84. In step S84, the controller 91 outputs a signal for turning on one solenoid 28 of the second solenoid valve 30 from an OUT port 92, and at the same time, starts the timer of the acceleration time measuring unit 120. When the solenoid 28 is turned on, the second port 30*c*2 of the third chamber 30*c* of the second solenoid valve 30 is connected to the branch communication path 17, and the fourth port 30*c*4 is connected to the air communication path 31*a*, thus supplying compressed air of 0.49 MPa (5 kgf/cm$^2$) from the first pressure adjustment device 16 into the first air chamber 34*a* of the pneumatic cylinder 34. At the same time, the third port 30*c*3 of the third chamber 30*c* of the second solenoid valve 30 is connected to the air communication path 27*b*, and the fifth port 30*c*5 is connected to the air communication path 31*b*, thus exhausting air in the second air chamber 34*b* of the pneumatic cylinder 34 to the air from the muffler 20 via the first solenoid valve 26. Then, the piston 36 begins to move from the right side toward the left side with respect to the pneumatic cylinder main body 34*c*. At this time, as described above, since the air in the second air chamber 34*b* is released to the air without any resistance, the piston 36 receives almost no counter pressure by the pressure in the second air chamber 34*b*, and begins to move at a very high speed.

In step S85, the controller 91 waits until the piston 36 moves to the position of the middle position sensor 40, the middle position sensor 40 responds, and a detection signal is input from an IN port 94. If the detection signal is input from the IN port 94 in step S85, the flow advances to step S85.

In step S86, the controller 91 stops the timer, subjected to measurement, of the acceleration time measuring unit 120, and stores the acceleration time Ta measured by the timer in the memory 104. Thereafter, the flow advances to step S87.

In step S87, the target deceleration time Tmd and the target wait time Tmw are calculated by the already calculated functions Fmd and Fmw on the basis of the measured acceleration time Ta.

In step S88, the target wait time Tmw is added to the wait time correction value Th stored in the memory, and the sum Tw is stored in the memory. This value Tw will be referred to as a wait time hereinafter. Since Th=0 is initially set, Tw=Tmw.

In step S89, the control waits until the middle position sensor 38 is turned on. If the sensor 38 is turned on, the flow advances to step S90. In step S90, the timer of the wait time measuring unit 110 is started. In step S91, the wait time Tw calculated in step S88 is compared with the value of the timer started in step S90, and the control waits until the timer value becomes equal to or larger than the wait time Tw. When the timer value becomes equal to or larger than the wait time Tw, the flow advances to step S92.

In step S92, the timer of the deceleration time measuring unit 112 is started, and the timer of the wait time measuring unit 110 is stopped. At the same time, the controller 91 turns on the solenoid 24 of the first solenoid valve 26. Then, the first port **26*b*1 of the second chamber 26*b* of the first solenoid valve 26 is connected to the air communication path 19, and the third port 26*b*3 is connected to the air communication path 27. As a result, compressed air of 0.29 MPa (3 kgf/cm$^2$) is supplied from the second pressure adjustment device 18 into the second air chamber 34*b* of the pneumatic cylinder 34. At this time, since the reverse flow of compressed air from the second pressure adjustment device 18 is prevented by the check valve 22, air will never reversely flow from the second air chamber 34*b* of the pneumatic cylinder, and the pressure in the second air chamber 34*b* steadily increases. Thus, the piston 36** begins to decelerate.

In step S93, the controller 91 waits until the piston 36 moves to the position (the left end position of the pneumatic cylinder main body **34*c*) of the stop position sensor 42, the stop position sensor 42 responds, and a detection signal is input from an IN port 94. If the detection signal is input from the IN port 94** in step S93, the flow advances to step S94.

In step S94, the timer of the deceleration time measuring unit 112 is stopped, and this time is stored in the memory 104 as a deceleration time Td. In step S95, a deviation Th' between the target deceleration time Tmd and the deceleration time Td is calculated. In this case, when the deviation Th'=0, i.e., when the actual deceleration time Td coincides with the target deceleration time Tmd, it indicates that the piston 36 has stopped at the end point position in a shock-free state, i.e., in an optimal state.

Then, the deviation Th' is multiplied with a predetermined constant Tk (e.g., 1/5). The product is determined to be the wait time correction value Th. When the piston 36 is moved from the right to the left next time, the wait time correction value Th is added to the target wait time Tmw to obtain the actual wait time Tw in step S88. Thus, the deviation between the actual deceleration time Td and the target deceleration time Tmd is fed back to the next operation of the piston 36, and when the moving operation of the piston 36 is repeated several times, the actual deceleration time Td converges to the target deceleration time Tmd. If the deviation Th' is 0, since Th is also 0, the actual wait time Tw is left unchanged in the next movement of the piston 36, and the deceleration of the piston 36 is started at the same timing as the current timing.

The reason why the value of the deviation Th' is not directly used as the wait time correction value Th is as follows. That is, since the frictional resistance or the like of a bearing of the cylinder apparatus slightly changes every time the piston 36 moves, if the deviation Th' is directly used as the wait time correction value Th, the value of the deceleration time Td may not converge to the target deceleration time Tmd. For this reason, when the deviation between the deceleration time Td and the target deceleration time Tmd becomes close to zero but does not easily become zero, the constant Tk is increased. When the deviation oscillates, i.e., when the sign of the deviation changes like +, −, +, −, . . . , the value of the constant Tk is decreased.

In step S96, the value Th stored in the memory 104 is updated with the value of the wait time correction value Th calculated in step S95. The wait time correction value Th stored in the memory 104 is used in the next movement of the piston 36 from the right end to the left end. In this step, the solenoid 24 of the solenoid valve 26 is turned off. Then, the compressed air to the second air chamber **34*b*** is exhausted to the air.

In step S97, the controller 91 measures an elapsed time from when the stop position sensor 42 responds, and a detection signal is input from an IN port 94. When the elapsed time has reached 0.5 sec, the controller 90 supplies a signal from an OUT port 92 to turn off the solenoid 28 of the second solenoid valve 30. Then, the second solenoid valve 30 is restored to the state illustrated in FIG. 19, and compressed air staying between the first air chamber **34*a* of the pneumatic cylinder 34 and the second solenoid valve 30 is exhausted to the air from the muffler 20**.

In this manner, after an elapse of about 1 sec from when the solenoid 28 is turned off, the pressures in the first and second air chambers **34*a* and 34*b* of the pneumatic cylinder 34 become equal to the atmospheric pressure. Thus, the moving operation of the piston 36 from the right end to the left end in FIG. 19** ends.

Note that movement of the piston 36 from the left end to the right end is controlled in the same manner as in the movement from the right end to the left end.

(Fifth Embodiment)

Figure 24:
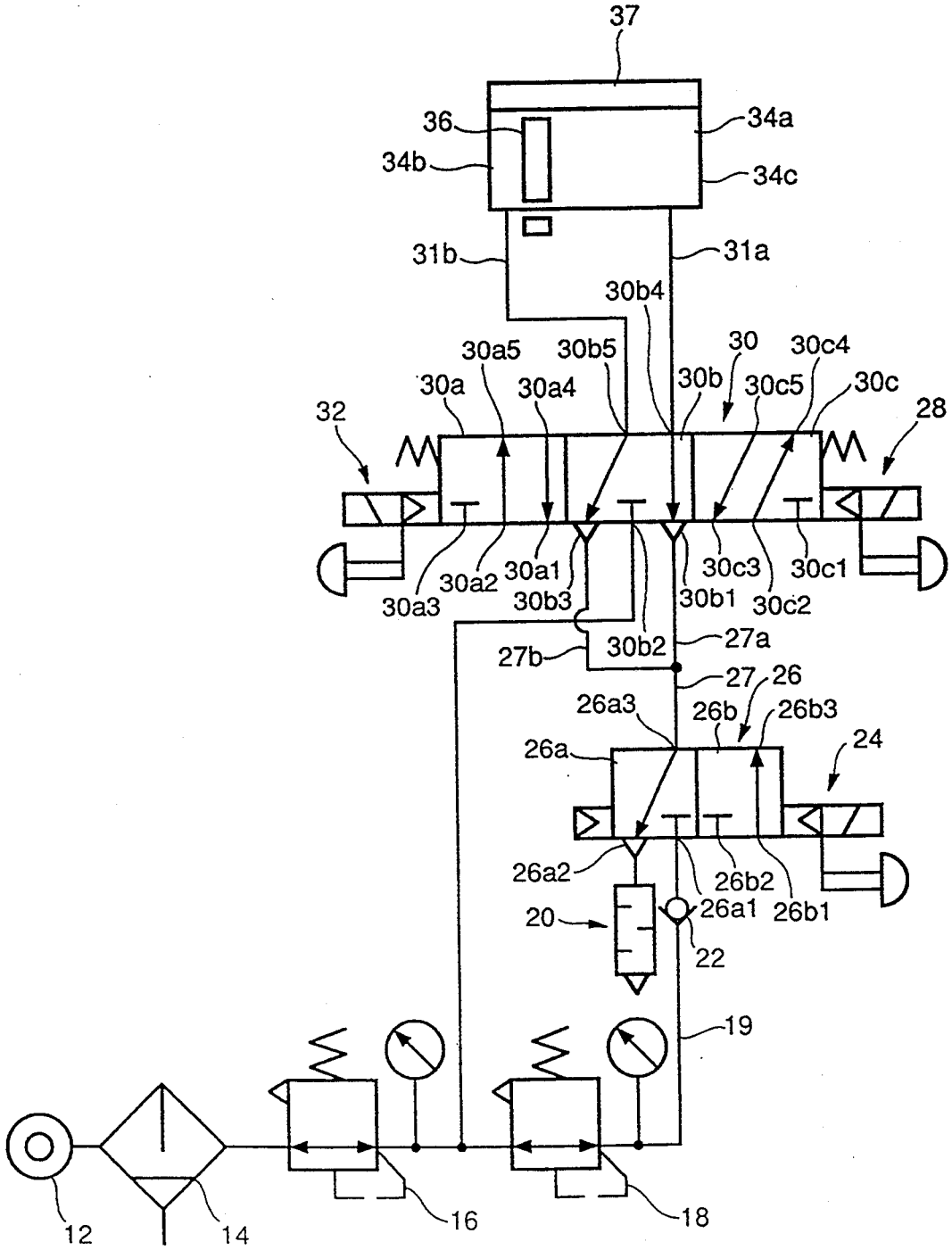
FIG. 24 is a pneumatic pressure circuit diagram showing an arrangement of a cylinder apparatus to which a control method of the fifth embodiment is applied.
Figure 25:
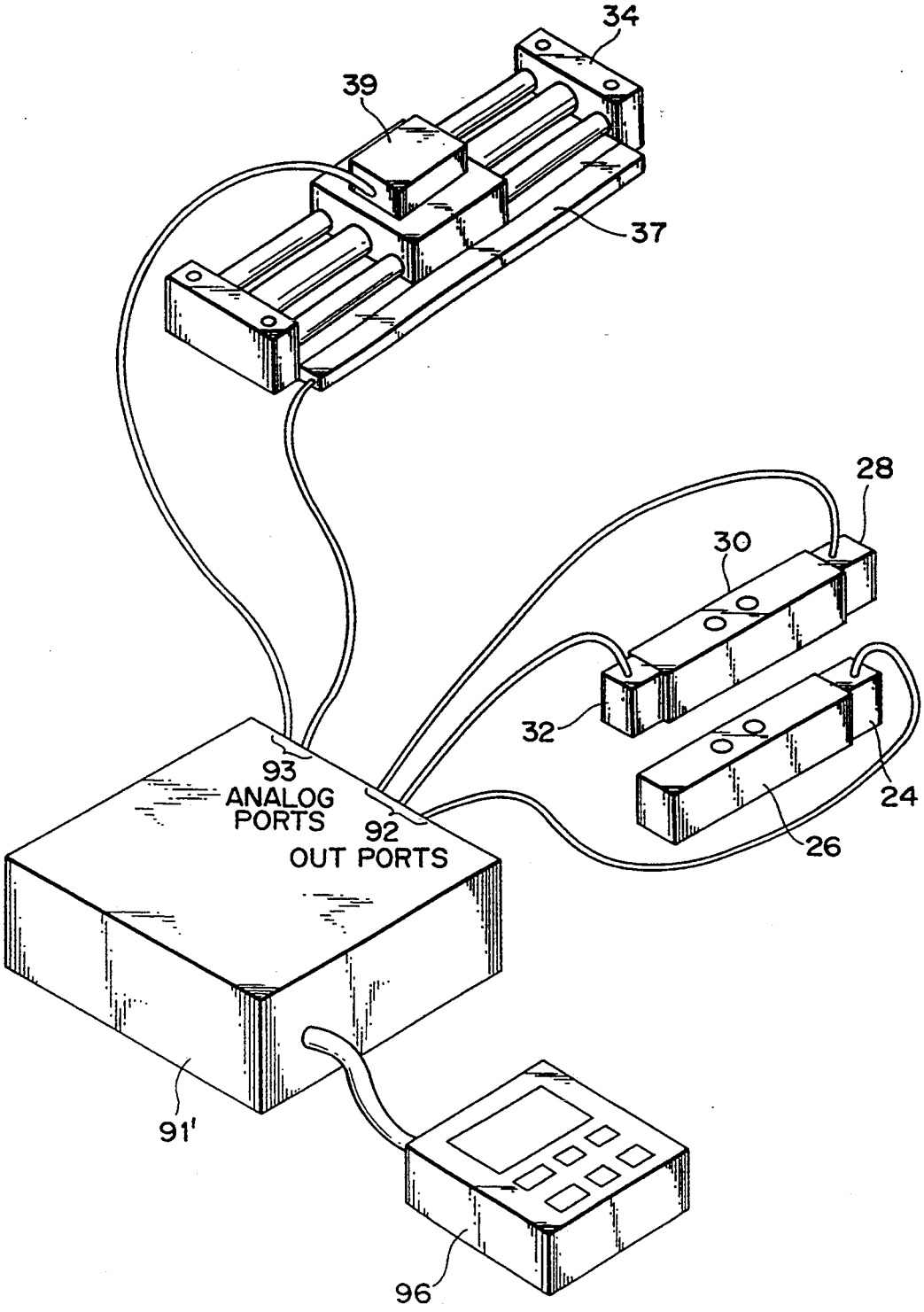
FIG. 25 is a perspective view showing the connection state among a controller, solenoids, and position sensors.
Figure 26:
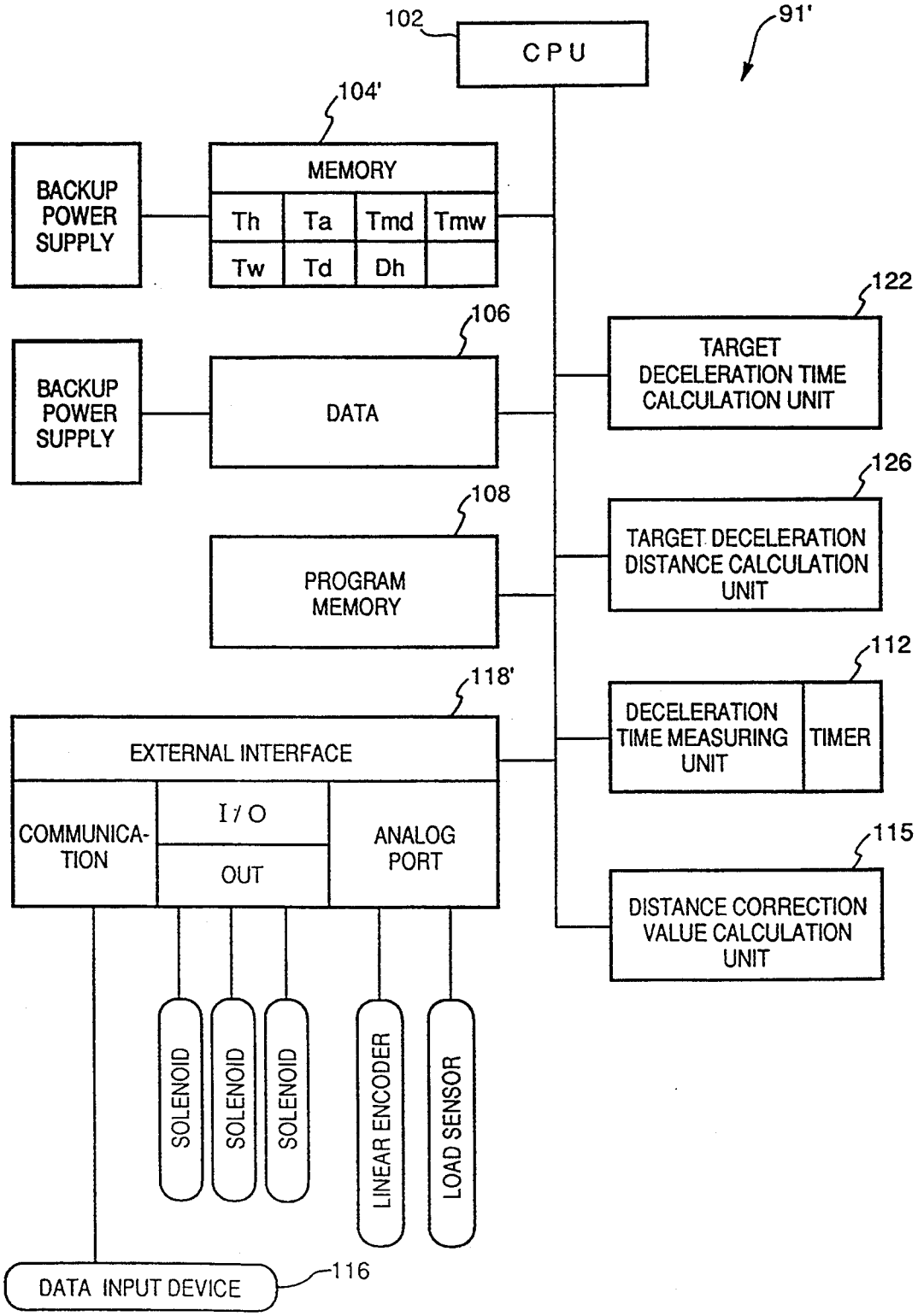
FIG. 26 is a block diagram of a system in the controller.

FIG. 24 is a pneumatic circuit diagram showing the arrangement of the fifth embodiment, and FIG. 25 is a perspective view showing the connection state among a controller, solenoids, and position sensors. FIG. 26 is a block diagram showing a system in a controller 91'.

In the fifth embodiment, the middle position sensors and the stop position sensors of the fourth embodiment are omitted, and a linear encoder 37 for detecting the position of the piston 36 is arranged aside the pneumatic cylinder main body **34*c* in place of the sensors. In correspondence with this arrangement, the IN ports of the controller 91 are omitted, and an analog port 93 is arranged. In addition, a load sensor 39 for measuring the load weight imposed on the piston 36 is arranged, and is connected to the analog port 93**.

As for the arrangement in the controller 91', the wait time measuring unit is omitted, and a distance correction value calculation unit 115 is arranged in place of the wait time correction value calculation unit. Since the load sensor 39 is arranged, the acceleration time need not be measured, and the acceleration time measuring unit is omitted. Furthermore, a target deceleration distance calculation unit 126 is added. Other arrangements are the same as those in the fourth embodiment. Therefore, the same reference numerals in this embodiment denote the same parts as in the fourth embodiment, and a detailed description thereof will be omitted. Note that components having reference numerals with ' have the same functions as those denoted by the same reference numerals in the fourth embodiment, but have slightly different arrangements.

The operation of the cylinder apparatus with the above arrangement will be described below.

As a pre-procedure upon conveying, e.g., a work in practice by the cylinder apparatus, a target deceleration distance Dd which is a distance from the beginning of deceleration to the stop of the piston 36 and which minimizes a shock upon stopping of the piston 36 must be measured. Also, a target deceleration time Tmd as the time required from the beginning of deceleration to the stop of the piston 36, i.e., the time required for moving the piston 36 across the target deceleration distance Dd, must be measured at the same time. A method of measuring the distance and time will be described below.

In the first embodiment, when the target deceleration time Tmd is measured in a state wherein a load (a load weight) of, e.g., 3 kgf is imposed on the piston 36, this value Tmd can only be used when a work of 3 kgf is conveyed. For this reason, when a work of another weight is to be conveyed, the target deceleration time Tmd must be measured again from the beginning.

In contrast to this, in the fifth embodiment, even when the load weight imposed on the piston 36 changes, a target deceleration distance Dd corresponding to the load can be predicted. More specifically, in the fifth embodiment, a load weight imposed on the piston 36 is measured by the load sensor 39, and target deceleration times Dd corresponding to at least two different load weights W (e.g., 3 kgf and 7 kgf) imposed on the piston are measured. More specifically, a combination of the load weight W and the target deceleration distance Dd is measured for each load weight W. A target deceleration distance Dd3 used when an intermediate load weight W3 (e.g., 5 kgf) between the two different load weights is imposed on the piston is predicted from the value of the load weight W3 on the basis of the at least two combinations (W1, Dd1) and (W2, Dd2) of the load weight and target deceleration distance.

The magnitude of the intermediate load weight W3 (in the above case, 5 kgf) is measured by the load sensor 39. The already measured two combinations (W1, Dd1) and (W2, Dd2) of the load weights and the target deceleration distances are considered as coordinate points on a graph, and these two points are linearly approximated, thereby calculating a target deceleration distance Dd3 corresponding to the load weight W3. In this manner, even when the load weight imposed on the piston 36 changes, the target deceleration distance can be predicted. When three or more combinations of the load weights W and the target deceleration distances Dd are calculated, three or more points on a graph can be calculated. When a curve passing these points is calculated by a least square approximation formula, the target deceleration distance Dd can be calculated more precisely.

A detailed procedure for measuring the target deceleration distance Dd in correspondence with each of a plurality of different load weights will be described below.

In an initial state, assume that all the solenoids 24, 28, and 32 are set in an OFF state (the state illustrated in FIG. 24), and the piston 36 is located at the right end (FIG. 24) of the pneumatic cylinder main body 34*c*.

A load weight of, e.g., 3 kgf is imposed on the piston 36 (for example, a weight of 3 kgf is attached to the piston 36). This load is measured by the load sensor 39. In this state, compressed air of 0.49 MPa (5 kgf/cm$^2$) is supplied from the first pressure adjustment device 16 into the first air chamber 34*a* of the pneumatic cylinder 34, and air in the second air chamber 34*b* is exhausted to the air from the muffler 20 via the first solenoid valve 26. Thus, the piston 36 begins to move from the right end toward the left end of the pneumatic cylinder main body 34*c*. The position of the piston 36 is measured by the linear encoder 37. When the piston 36 passes a position near the center of the pneumatic cylinder main body 34*c*, compressed air of 0.29 MPa (3 kgf/cm$^2$) is supplied from the second pressure adjustment device 18 to the second air chamber 34*b*, thereby braking the piston 36. The piston 36 moves toward the end point position at the left end portion of the pneumatic cylinder main body 34*c* while its moving speed is being decelerated, and finally stops.

The stop position is determined by the braking start position of the piston 36. Therefore, depending on the braking start position of the piston 36, the piston 36 may stop before it reaches the end point, may stop just at the end point position, or may not stop before it reaches the end point position, and may collide against the left inner wall of the pneumatic cylinder main body 34*c*. Of these cases, it is most preferable that the piston 36 be stopped just at the end point position.

The deceleration start position of the piston, which position allows the piston 36 to stop just at the end point position, is experimentally obtained while the position of the piston 36 is being measured by the linear encoder 37. In practice, however, since the sliding resistance or the like of a bearing slightly changes every time the piston 36 moves, it is impossible to always stop the piston 36 just at the end point position. When the piston 36 stops before it reaches the end point position, a work or the like as an object to be conveyed cannot be conveyed to the target position, thus posing another problem. For this reason, in practice, an optimal deceleration start position is obtained, so that the piston 36 collides against the end point position with a slight shock, and stops at that position.

In this case, the magnitude of the shock upon collision of the piston 36 against the end point position is determined by detecting the acceleration of the piston 36 at the time of collision or measuring the amplitude of a vibration in the longitudinal direction of the cylinder 34. The deceleration start position of the piston 36 is adjusted to reduce the shock upon collision of the piston 36 as much as possible. This optimal deceleration start position is experimentally determined by repetitively moving the piston 36. The distance from the optimal deceleration start position to the end point position is measured, and is defined to be the target deceleration distance Dd. Also, the time required for moving the piston 36 from the optimal deceleration start position to the end point position is defined to be the target deceleration time Tmd.

In this manner, a target deceleration distance Dd1 and a target deceleration time Tmd1 are measured in correspondence with one load weight W1 (i.e., the load weight of 3 kgf). By the same method, a target deceleration distance Dd2 and a target deceleration time Tmd2 are measured in correspondence with the other load weight W2 (e.g., 7 kgf). Note that the measurement operations of these times are performed under an identical cylinder condition in a no-load state. When the target deceleration distance and target deceleration time are measured in correspondence with a larger number of different load weights, prediction precision of the target deceleration distance and target deceleration time can be improved.

A relation between each load weight W and the corresponding target deceleration distance Dd which is measured, as described above, is obtained as an n-th order least square approximation formula. If the obtained relation is represented by Fd, the target deceleration distance Dd is given by:

$$Dd = Fd(W)$$

The target deceleration distance calculation unit 126 calculates the target deceleration distance Dd from the value of the load weight W in accordance with this function.

Also, a relation between each load weight W and the corresponding target deceleration time Tmd is obtained as an n-th order least square approximation formula. If the obtained relation is represented by Fmd, the target deceleration time Tmd is given by:

$$Tmd = Fmd(W)$$

The above-mentioned target deceleration time calculation unit 122 calculates the target deceleration time Tmd from the value of the load weight W in accordance with this function. Upon calculation of the function Fmd, when the value of the target deceleration time Tmd is measured in correspondence with a larger number of different load weights W, an approximation function with higher precision can be obtained as in the case of the function used for calculating the target deceleration distance Dd.

Note that the functions Fd and Fmd, which are calculated, as described above, are stored in the controller.

Figure 27:
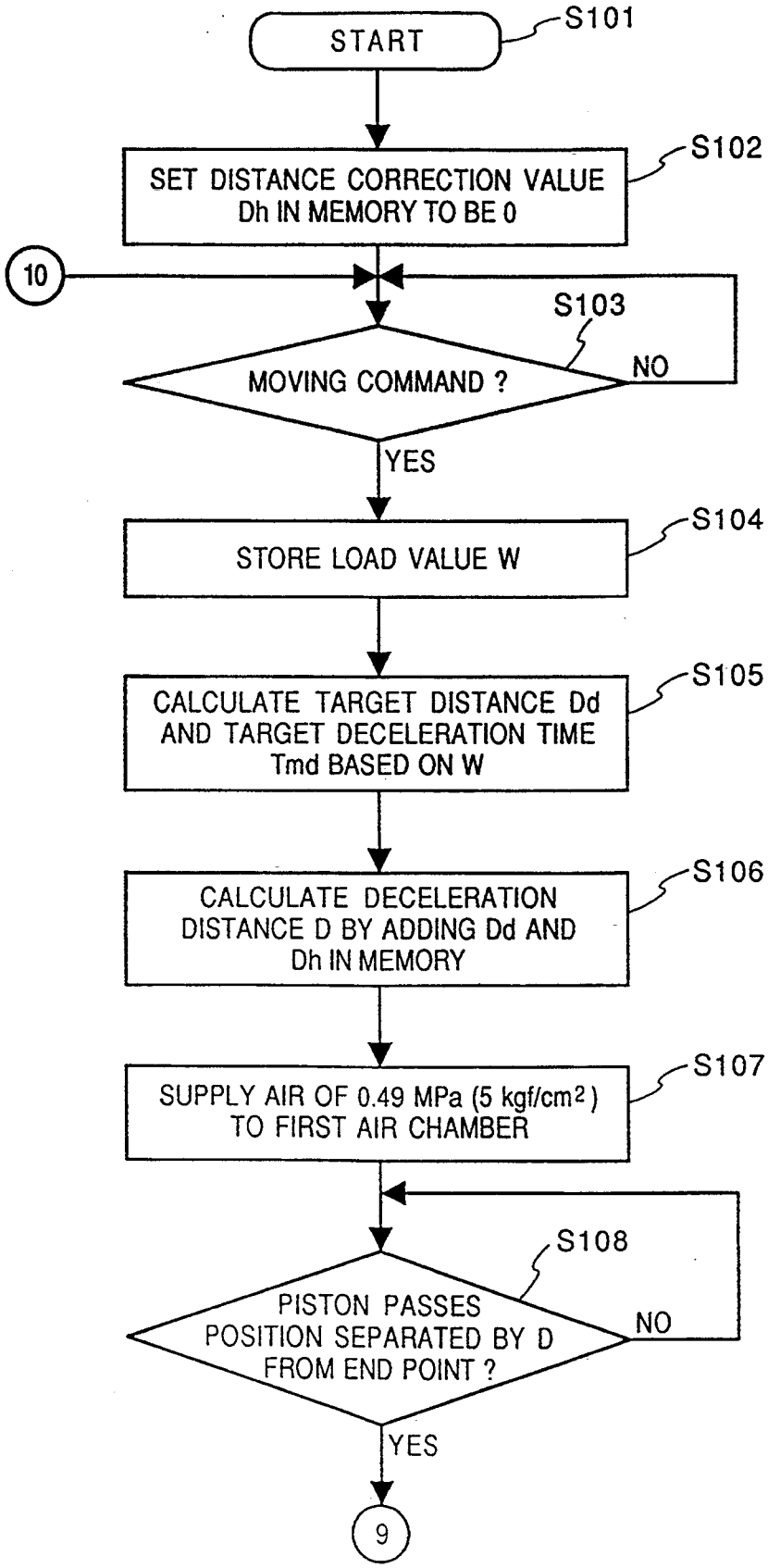
FIG. 27 is a flow chart for explaining an operation for moving a piston.
Figure 28:
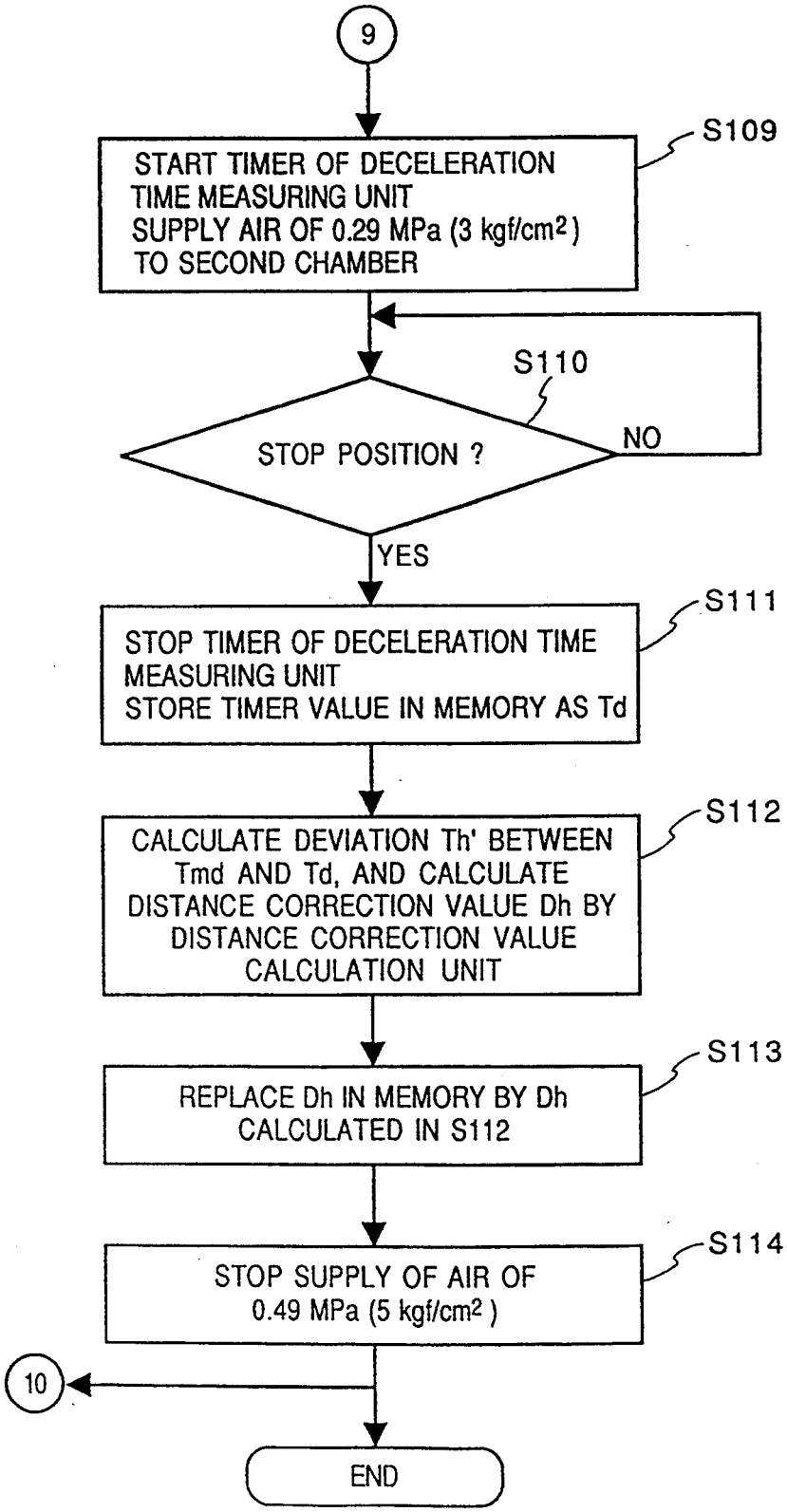
FIG. 28 is a flow chart for explaining the operation for moving the piston.

An operation for moving the piston 36 of the pneumatic cylinder 34 from the right end to the left end (FIG. 24) on the basis of the functions Fd and Fmd which are calculated, as described above, and stopping the piston 36 without any shock will be described below with reference to the flow charts shown in FIGS. 27 and 28.

In an initial state, assume that all the solenoids 24, 28, and 32 are set in an OFF state (the state illustrated in FIG. 24), and the piston 36 is located at the right end (FIG. 24) of the pneumatic cylinder main body 34*c*.

Step S101 is the start step. In step S102, a distance correction value Dh in the memory is set to be 0. In step S103, the control waits until a moving command is output from the CPU 102. When the moving command is output, the flow advances to step S104. In step S104, the load value measured by the load sensor 39 is stored as W. In step S105, the target deceleration distance Dd and the target deceleration time Tmd are calculated from the load value W in accordance with the prestored functions Fd and Fmd. In step S106, the target deceleration distance Dd calculated in step S105 is added to the distance correction value Dh stored in the memory 104' to calculate the deceleration distance D, and this value is stored in the memory 104'. Since Dh=0 is initially set, D=Dd.

In step S107, the controller 91' outputs a signal for turning on one solenoid 28 of the second solenoid valve 30 from an OUT port 92 to connect the second port 30*c*2 of the third chamber 30*c* of the second solenoid valve 30 to the branch communication path 17, and to connect the fourth port 30*c*4 to the air communication path 31*a*, thus supplying compressed air of 0.49 MPa (5 kgf/cm$^2$) from the first pressure adjustment device 16 into the first air chamber 34*a* of the pneumatic cylinder 34. At the same time, the third port 30*c*3 of the third chamber 30*c* of the second solenoid valve 30 is connected to the air communication path 27*b*, and the fifth port 30*c*5 is connected to the air communication path 31*b*, thus exhausting air in the second air chamber 34*b* of the pneumatic cylinder 34 to the air from the muffler 20 via the first solenoid valve 26. Then, the piston 36 begins to move from the right side toward the left side with respect to the pneumatic cylinder main body 34*c*. At this time, as described above, since the air in the second air chamber 34*b* is released to the air without any resistance, the piston 36 receives almost no counter pressure by the pressure in the second air chamber 34*b*, and begins to move at a very high speed.

In step S108, the control waits until the piston 36 reaches a position separated from the end point position by the distance D. When the piston 36 has reached the position, the flow advances to step S109. In step S109, the timer of the deceleration time measuring unit 112 is started. At the same time, the controller 91' turns on the solenoid 24 of the first solenoid valve 26. Then, the first port 26*b*1 of the second chamber 26*b* of the first solenoid valve 26 is connected to the air communication path 19, and the third port 26*b*3 is connected to the air communication path 27, thus supplying compressed air of 0.29 MPa (3 kgf/cm$^2$) from the second pressure adjustment device 18 to the second air chamber 34*b* of the pneumatic cylinder 34. At this time, since the reverse flow of compressed air from the second pressure adjustment device 18 is prevented by the check valve 22, air will never reversely flow from the second air chamber 34*b* of the pneumatic cylinder, and the pressure in the second air chamber 34*b* can reliably increase. Thus, the piston 36 begins to decelerate.

When the controller 91' detects based on the output signal from the linear encoder 37 in step S110 that the piston 36 has moved to the stop position (the left end position of the pneumatic cylinder main body 34*c*), the flow advances to step S111.

In step S111, the timer of the deceleration time measuring unit 112 is stopped, and this time is stored in the memory 104' as a deceleration time Td. In step S112, a deviation Th' between the above-mentioned target deceleration time Tmd and the deceleration time Td is calculated. When the deviation Th'=0, i.e., when the actual deceleration time Td coincides with the target deceleration time Tmd, it indicates that the piston 36 has stopped at the end point position in a shock-free state, i.e., in an optimal state.

Then, the deviation Th' is multiplied with a predetermined constant Tk (e.g., 1/5×the moving speed of the piston). The product is determined to be the distance correction value Dh. When the piston 36 is moved from the right to the left next time, the distance correction value Dh is added to the target deceleration distance Dd to calculate an actual deceleration distance D in step S106. Thus, the deviation between the actual deceleration time Td and the target deceleration time Tmd is fed back to the next operation of the piston 36, and when the moving operation of the piston 36 is repeated several times, the actual deceleration time Td converges to the target deceleration time Tmd. If the deviation Th' is 0, since Th is also 0, the deceleration distance D is left unchanged in the next movement of the piston 36, and the deceleration of the piston 36 is started from the same position as that in the current operation.

The reason why a value obtained by multiplying the deviation Th' with the moving speed of the piston is not directly used as the distance correction value Dh is as follows. That is, since the frictional resistance or the like of a bearing of the cylinder apparatus slightly changes every time the piston 36 moves, if the value obtained by multiplying the deviation Th' with the moving speed of the piston is directly used as the distance correction value Dh, the value of the deceleration time Td may not converge to the target deceleration time Tmd. For this reason, when the deviation between the deceleration time Td and the target deceleration time Tmd becomes close to zero but does not easily become zero, the constant Tk is increased. When the deviation oscillates, i.e., when the sign of the deviation changes like +, −, +, −, . . . , the value of the constant Tk is decreased.

In step S113, the value Dh stored in the memory 104' is updated with the value of the distance correction value Dh calculated in step S112. The distance correction value Dh stored in the memory 104' is used in the next movement of the piston 36 from the right end to the left end. In this step, the solenoid 24 of the solenoid valve 26 is turned off. Then, the compressed air to the second air chamber **34*b*** is exhausted to the air.

In step S114, the controller 91' measures an elapsed time from when the linear encoder 37 detects that the piston 36 has reached the end point position. When this elapsed time has reached 0.5 sec, the controller 91' supplies a signal from an OUT port 92 to turn off the solenoid 28 of the second solenoid valve 30. Then, the second solenoid valve 30 is restored to the state illustrated in FIG. 24, and compressed air staying between the first air chamber **34*a* of the pneumatic cylinder 34 and the second solenoid valve 30 is exhausted to the air from the muffler 20**.

In this manner, after an elapse of about 1 sec from when the solenoid 28 is turned off, the pressures in the first and second air chambers **34*a* and 34*b* of the pneumatic cylinder 34 become equal to the atmospheric pressure. Thus, the moving operation of the piston 36 from the right end to the left end in FIG. 24** ends.

Note that movement of the piston 36 from the left end to the right end is controlled in the same manner as in the movement from the right end to the left end.

As described above, according to each of the above embodiments, even the sliding resistance changes during the operation of the piston, the piston can always be smoothly stopped at the end point position. Even when the load of an object to be conveyed changes, the apparatus of the present invention can cope with the change. Note that the present invention can be applied to changes and modifications of the embodiments without departing from the spirit and scope of the invention.

The present invention is not limited to the above embodiments and various changes and modifications can be made within the spirit and scope of the present invention. Therefore, to apprise the public of the scope of the present invention the following claims are made.

What is claimed is:

1. A method of controlling a cylinder apparatus, comprising the steps of:

supplying compressed air of a first high pressure to a first chamber of a cylinder which is divided into first and second chambers by a piston, and exhausting air from the second chamber so as to move the piston from a start position at an end portion of the first chamber toward an end position at an end portion of the second chamber along an extending direction of the cylinder;

providing first detection means, arranged on the cylinder, for detecting when the piston passes a first position; and decreasing a moving speed of the piston by supplying air of a second high pressure lower than the first high pressure to the second chamber after an elapse of a wait time from when the piston is detected to pass the first position so that the piston reaches the end position with a collision force lower than a predetermined level.

2. The method according to claim 1, wherein the moving speed decreasing step includes the step of changing the wait time so as to cause a deceleration time as a time from the beginning of the decreasing of the moving speed of the piston to arrival of the piston at the end position to coincide with a predetermined target deceleration time.

3. The method according to claim 2, wherein the target deceleration time is a time which is counted from the beginning of the decreasing of the moving speed of the piston to arrival of the piston at the end position and with which a shock upon collision of the piston against the end position is lower than the predetermined level.

4. The method according to claim 3, wherein the target deceleration time is experimentally obtained by moving the piston in practice.

5. The method according to claim 4, wherein the target deceleration time is determined by measuring reactive acceleration upon collision of the piston against the end position.

6. The method according to claim 4 wherein the target deceleration time is determined by measuring an amplitude of a vibration upon collision of the piston against the end position.

7. A method according to claim 3, wherein the step of supplying compressed air of a first high pressure includes the sub-steps of:

first moving the piston along the extending direction of the cylinder by supplying compressed air of the first high pressure to the first chamber, and exhausting air from the second chamber;

measuring an acceleration time as a moving time from a beginning of the movement of the piston from the start position to arrival of the piston at a position matching second detection means arranged between the start position and the first detection means; and calculating the target deceleration time on the basis of the acceleration time.

8. The method according to claim 2, wherein when the deceleration time changes, the wait time is changed on the basis of a change amount of the deceleration time to cause the deceleration time to coincide with the target deceleration time.

9. The method according to claim 8, wherein the wait time is changed by adding a value obtained by multiplying the change amount of the deceleration time with a predetermined coefficient to the wait time.

10. The method according to claim 1, wherein the step of supplying compressed air at a first high pressure includes the sub-steps of:

first moving the piston along the extending direction of the cylinder by supplying compressed air of the first high pressure to the first chamber, and exhausting air from the second chamber;

measuring an acceleration time as a moving time from a beginning of the movement of the piston from the start position to arrival of the piston at a position matching second detection means arranged between the start position and the first detection means; and calculating the wait time on the basis of the acceleration time.

11. The method according to claim 1, wherein the step of supplying compressed air of the first high pressure into the first chamber is done after air in the second chamber is exhausted in advance.

12. The method according to claim 1, further comprising the step of exhausting air of the second high pressure from the second chamber after the piston is detected to reach the end position.

13. A method of controlling a cylinder apparatus, comprising the steps of:

supplying compressed air of a first high pressure to a first chamber of a cylinder which is divided into first and second chambers by a piston, and exhausting air from the second chamber so as to move the piston from a start position at an end portion of the first chamber toward an end position at an end portion of the second chamber along an extending direction of the cylinder;

providing detection means, arranged on the cylinder, for detecting a position of the piston to detect a remaining moving distance as a distance between a current position of the piston and the end position; and decreasing a moving speed of the piston by supplying air of a second high pressure lower than the first high pressure to the second chamber when the remaining moving distance becomes equal to a target distance, wherein the target distance is changed so as to cause a deceleration time as a time from a beginning of the decreasing of the moving speed of the piston to arrival of the piston at the end position to coincide with a predetermined target deceleration time.

14. The method according to claim 13, wherein the target deceleration time is a time which is counted from the beginning of the decreasing of the moving speed of the piston to arrival of the piston at the end position and with which a shock upon collision of the piston against the end position is lower than a predetermined level.

15. The method according to claim 14, wherein the target deceleration time is experimentally obtained by moving the piston in practice.

16. The method according to claim 15, wherein the target deceleration time is determined by measuring an acceleration upon collision of the piston against the end position.

17. The method according to claim 15, wherein the target deceleration time is determined by measuring an amplitude of a vibration upon collision of the piston against the end position.

18. The method according to claim 14, wherein the target deceleration time is calculated from a weight of an additional load imposed on the piston.

19. The method according to claim 13, wherein when the deceleration time changes, the target distance is changed on the basis of a change amount of the deceleration time to cause the deceleration time to coincide with the target deceleration time.

20. The method according to claim 19, wherein the target distance is changed by adding a value obtained by multiplying the change amount of the deceleration time with a predetermined coefficient to the distance.

21. The method according to claim 13, wherein the step of supplying compressed air of the first high pressure into the first chamber is done after air in the second chamber is exhausted in advance.

22. The method according to claim 13, further comprising the step of exhausting air of the second high pressure from the second chamber after the piston is detected to reach the end position.

23. A method of controlling a cylinder apparatus, comprising the steps of:

supplying compressed air of a first high pressure to a first chamber of a cylinder which is divided into first and second chambers by a piston, so as to move the piston from a start position at an end portion of the first chamber toward an end position at an end portion of the second chamber along an extending direction of the cylinder;

providing first detection means, arranged on the cylinder, for detecting when the piston passes a first position;

exhausting air from the second chamber; and decreasing a moving speed of the piston by supplying air of a second high pressure lower than the first high pressure to the second chamber after an elapse of a wait time from when the piston is detected to pass the first position so that the piston reaches the end position with a shock lower than a predetermined level.

* * * * *

UNITED STATES PATENT AND TRADEMARK OFFICE

CERTIFICATE OF CORRECTION

PATENT NO. : 5,431,086

DATED : July 11, 1995

INVENTOR(S) : Morita et al.

It is certified that error appears in the above-indentified patent and that said Letters Patent is hereby corrected as shown below: Title page, item

[56] REFERENCES CITED: and Col. 2, line 1,

FOREIGN PATENT DOCUMENTS, "416335 1/1992 Japan" should read 4-16335 1/1992 Japan--.

COLUMN 32:

Line 23, "distance." should read --target distance.--.

Signed and Sealed this

Nineteenth Day of December, 1995

*Attest:*

*Attesting Officer*

BRUCE LEHMAN

*Commissioner of Patents and Trademarks*